US009038780B2

(12) United States Patent
Drew et al.

(10) Patent No.: US 9,038,780 B2
(45) Date of Patent: May 26, 2015

(54) SAFETY BRAKE FOR INCLINE ELEVATORS

(75) Inventors: Rob Drew, Vancouver, WA (US); Chris Thomsen, Seattle, WA (US)

(73) Assignee: GEOSEN, Seattle, WA (US)

( * ) Notice: Subject to any disclaimer, the term of this patent is extended or adjusted under 35 U.S.C. 154(b) by 453 days.

(21) Appl. No.: 13/149,657

(22) Filed: May 31, 2011

(65) Prior Publication Data

US 2011/0290590 A1 Dec. 1, 2011

Related U.S. Application Data

(60) Provisional application No. 61/349,961, filed on May 31, 2010.

(51) Int. Cl.

| | |
|---|---|
| ***B66B 9/06*** | (2006.01) |
| ***B66B 7/02*** | (2006.01) |
| ***B66B 5/20*** | (2006.01) |

(52) U.S. Cl.

CPC . *B66B 7/022* (2013.01); *B66B 9/06* (2013.01); *B66B 5/20* (2013.01)

(58) Field of Classification Search

CPC ..... B66B 5/18; B66B 5/20; B66B 9/06; B66B 7/022

USPC ..... 187/245, 367, 368, 374, 202; 188/30, 188/40, 82.1, 82.8

See application file for complete search history.

(56) References Cited

U.S. PATENT DOCUMENTS

| | | | | |
|---|---|---|---|---|
| 1,714,297 | A * | 5/1929 | Crispen | 187/406 |
| 4,046,226 | A * | 9/1977 | Flinchbaugh | 187/202 |
| 2005/0224302 | A1 * | 10/2005 | Robertsson et al. | 188/40 |
| 2011/0120809 | A1 * | 5/2011 | Kocher et al. | 187/249 |

* cited by examiner

*Primary Examiner* — William E Dondero
*Assistant Examiner* — Diem Tran
(74) *Attorney, Agent, or Firm* — Michelle E. Carey; Michael Gibbons; Telekta Law, P.S.

(57) ABSTRACT

An incline elevator with a load carrying unit running on a U-shaped track. The load carrying unit is mounted on trucks engaging the track. Below the trucks are swivelably mounted eccentric safety devices, with roller guides spring loaded against the interior walls of the channel, and eccentric brakes retracted during normal operation or extended during emergencies like a break in the elevator hoist cable. The eccentric brakes are retracted when both mechanically and electrically driven linkages are engaged. The brakes are retracted when tension is present in the hoist cable, and when electrical speed sensors sense an underspeed condition. The eccentric brakes deploy when either there is a hoist cable break, an overspeed condition, or an incline elevator power failure. The eccentric brakes are spring loaded to swing out, engaging the interior walls of the channel of the track, and jam in position stopping the load carrying unit.

21 Claims, 26 Drawing Sheets

SAFETY BRAKE FOR INCLINE ELEVATORS

PRIORITY CLAIM

This application claims the benefit of U.S. provisional patent application Ser. No. 61/349,961 filed May 31, 2010 (our ref. ABAR-1-1001). The foregoing application is incorporated by reference in its entirety as if fully set forth herein.

FIELD OF THE INVENTION

This invention relates generally to elevators, and more specifically, to a safety brake for incline elevators.

BACKGROUND

Elevators are conventionally provided with a safety brake. A safety brake is designed to bring an elevator cab or gondola to a halt in case of an emergency. The safety brake is a redundant device. In most elevators, the motor that drives the elevator has its own braking system that is used in normal operation, with the safety brake only engaging during a fault condition.

Previous systems for providing a safety brake include mainly passive means for detecting only the most serious faults, such as a break in the hoist cable. Other conditions, such as a power failure or an overspeed condition not resulting from a hoist cable break, are not necessarily addressed within the safety brake mechanism. Further, prior safety brake designs can be primitive, serving the basic need of life safety but having other negative effects. For example, one such design for an incline elevator involves a hook that swings back and catches a portion of the elevator framework, resulting in a sudden arrest of downward travel of the elevator cab that is uncomfortable for passengers, and additionally resulting in possible damage to the elevator framework itself.

For maximum safety, it is desirable to provide a safety break design which engages upon detection of any one of a number of different faults. Optimally, the system would detect both mechanical and electrical faults. For passenger comfort and minimization of mechanical damage to the elevator following a deployment of the safety brake, a smoother deceleration to a stop is also desirable. Further, new building and construction codes coming into vogue require levels of redundancy for elevator safety brakes not previously implemented.

Accordingly, this application discloses a system for a safety brake for incline elevators.

SUMMARY

The invention relates generally to elevators, and more specifically, to a safety brake for incline elevators. In some embodiments, an incline elevator includes a gondola mounted to a load carrying unit, the chassis of the load carrying unit being mounted to trucks which ride along a U-shaped track with flanges to either side of the U-shaped track. In some embodiments, a truck includes top and bottom roller wheels which engage the flange of the track. In a further embodiment, beneath each truck is swivelably mounted an eccentric safety device, the eccentric safety device having guide rollers at each end, the eccentric safety device being spring loaded to push the guide rollers against opposing sides of the inside of the channel of the U-shaped track.

In some embodiments, an eccentric safety device swivelably mounted below a truck of a load carrying unit of an incline elevator includes a bottom eccentric brake and a top eccentric brake, the eccentric brakes being swivelably mounted onto a center pin disposed through the center of the eccentric safety device, the center pin also being disposed through a safety mounting tube in the truck, such that the eccentric safety device is swivelably mounted underneath the truck, swiveling from side to side about the center pin so that its guide rollers engage the interior wall of the channel of the U-shaped track. In some embodiments, the eccentric brakes swivel about the center pin such that they can also engage the interior wall of the channel of the U-shaped track. However, in this embodiment, the pear-shaped construction of the eccentric brakes, with a fat end oriented towards the downhill side of the eccentric brakes and the skinny end oriented towards the uphill side of the eccentric brakes, ensures that when the eccentric brakes swing out about the center pin such that the brakes extend further outside the periphery of the frame of the eccentric safety device, the eccentric brakes when engaging the interior wall of the U-shaped channel "jam" the eccentric safety device and the load carrying unit to which the eccentric safety device is mounted, bringing the load carrying unit to a stop on the track.

In some embodiments, the eccentric brakes are tensionally biased by a brake spring to extend. In a certain embodiment, the eccentric brakes can be retracted so as to no longer engage the interior side wall of the U-shaped channel of the track, the retraction of the eccentric brakes acting against the tension of the brake spring. In some embodiments, for the eccentric brakes to be retracted, both mechanical and electrical linkages must be engaged. In a certain embodiment, the eccentric brakes are coupled to an eccentric bell crank by a brake cable, the eccentric bell crank being swivelably mounted on an axle of the truck of the load carrying unit of the incline elevator. In some embodiments, the eccentric bell crank is rotated when it engages a docking target mounted on a track of an incline elevator at a station of an incline elevator, retracting the eccentric brakes. In such embodiments, the eccentric bell crank can be held in the rotated position such that the eccentric brakes stay retracted by engagement with an electrically-powered solenoid that engages the eccentric bell crank and keeps the eccentric brakes retracted, even when the load carrying unit moves away from a station and the docking target no longer engages the eccentric bell crank.

In some embodiments, a solenoid is mounted to a hoist cable bell crank, the hoist cable bell crank being swivelably mounted to an axle of the truck of the load carrying unit. In certain embodiments, a hoist cable bell crank is spring loaded and tensionally biased such that the solenoid mounted to the hoist cable bell crank is rotated away from the eccentric bell crank, preventing the solenoid from engaging the eccentric bell crank. In some embodiments, for the hoist cable bell crank to be rotated against the spring of the hoist cable bell crank, tension must be present in the hoist cable. That is, if the hoist cable breaks and there is no tension in the hoist cable, the hoist cable bell crank will be rotated by spring tension such that the solenoid may not engage the eccentric bell crank. In this embodiment, the loss of contact between the solenoid and the eccentric bell crank will cause the spring tension in the brake spring to rotate the eccentric brakes out, engaging with the interior wall of the channel of the U-shaped track and bringing the load carrying unit to a halt.

In some embodiments, power is provided to a solenoid from electrical wiring running from the power source of the incline elevator. In a certain embodiment, the power is provided to the solenoid by a pair of electrically-powered speed sensors which are in series with the solenoid. In this embodiment, if there is no power in the incline elevator system, the speed sensors will not be powered and can not provide power to the solenoid; consequently, if there is a power loss to the incline elevator, the solenoid will disengage from the eccentric bell crank, and the eccentric brakes will extend, stopping the load carrying unit. In some embodiments, if the electrically-powered speed sensors detect an overspeed condition, the electrically-powered speed sensors will cut power to the solenoid and the solenoid will disengage from the eccentric bell crank, and the eccentric brakes will extend, stopping the load carrying unit.

Accordingly, in some embodiments, an eccentric safety device for an incline elevator provides safety braking for a load carrying unit that has moved from its docking target by eccentric brakes when there is a power failure, an overspeed condition, or a break in the hoist cable.

BRIEF DESCRIPTION OF THE DRAWINGS

Embodiments of the present invention are described in detail below with reference to the following drawings:

FIG. 1*a* is a side view of an incline elevator, in accordance with an embodiment of the invention;

FIG. 1*b* is a perspective view of an incline elevator, in accordance with an embodiment of the invention;

FIG. 2*a* is a perspective exploded view of the track of an incline elevator, in accordance with an embodiment of the invention;

FIG. 2*b* is a front cross-sectional view of the track of an incline elevator, in accordance with an embodiment of the invention;

FIG. 3*a* is an exploded perspective view of a load carrying unit for deployment on a track of an incline elevator, in accordance with an embodiment of the invention;

FIG. 3*b* is a perspective view of a load carrying unit for deployment on a track of an incline elevator, in accordance with an embodiment of the invention;

FIG. 3*c* is a detailed exploded view of a load carrying unit of an incline elevator, in accordance with an embodiment of the invention;

FIG. 3*d* is a front cross-sectional view of a load carrying unit deployed on a track of an incline elevator, in accordance with an embodiment of the invention;

FIG. 4*a* is an exploded detail perspective view of a truck and eccentric safety device of a load carrying unit for an incline elevator, in accordance with an embodiment of the invention;

FIG. 4*b* is a top cross-sectional view of a truck and eccentric safety device of a load carrying unit deployed on a track of an incline elevator, in accordance with an embodiment of the invention;

FIG. 5*a* is a perspective view of an eccentric safety device of an incline elevator, in accordance with an embodiment of the invention;

FIG. 5*b* is an exploded perspective view of an eccentric safety device of an incline elevator, in accordance with an embodiment of the invention;

FIG. 5*c* is an exploded perspective view of a portion of an eccentric safety device of an incline elevator, in accordance with an embodiment of the invention;

FIG. 5*d* is a side view of a portion of an eccentric safety device of an incline elevator, in accordance with an embodiment of the invention;

FIG. 5*e* is a rear view of a portion of an eccentric safety device of an incline elevator, in accordance with an embodiment of the invention;

FIG. 5*f* is a top cross-sectional view of an eccentric safety device deployed on a track of an incline elevator, in accordance with an embodiment of the invention;

FIG. 6*a* is a perspective view of an eccentric bell crank for an eccentric safety device of an incline elevator, in accordance with an embodiment of the invention;

FIG. 6*b* is a side view of an eccentric bell crank for an eccentric safety device of an incline elevator, in accordance with an embodiment of the invention;

FIG. 7*a* is a perspective view of a hoist cable bell crank of an eccentric safety device of an incline elevator, in accordance with an embodiment of the invention;

FIG. 7*b* is a perspective view of a safety link joining two hoist cable bell cranks, in accordance with an embodiment of the invention;

FIG. 8*a* is a perspective view of a speed sensor coupled with an eccentric safety device of an incline elevator, in accordance with an embodiment of the invention;

FIG. 8*b* is a perspective view of a speed sensor coupled with an eccentric safety device integrated with a truck of an incline elevator, in accordance with an embodiment of the invention.

DETAILED DESCRIPTION

The invention relates generally to elevators, and more specifically, to a safety brake for incline elevators.

Specific details of certain embodiments of the invention are set forth in the following description and in FIGS. 1*a*-9*c* to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1A:
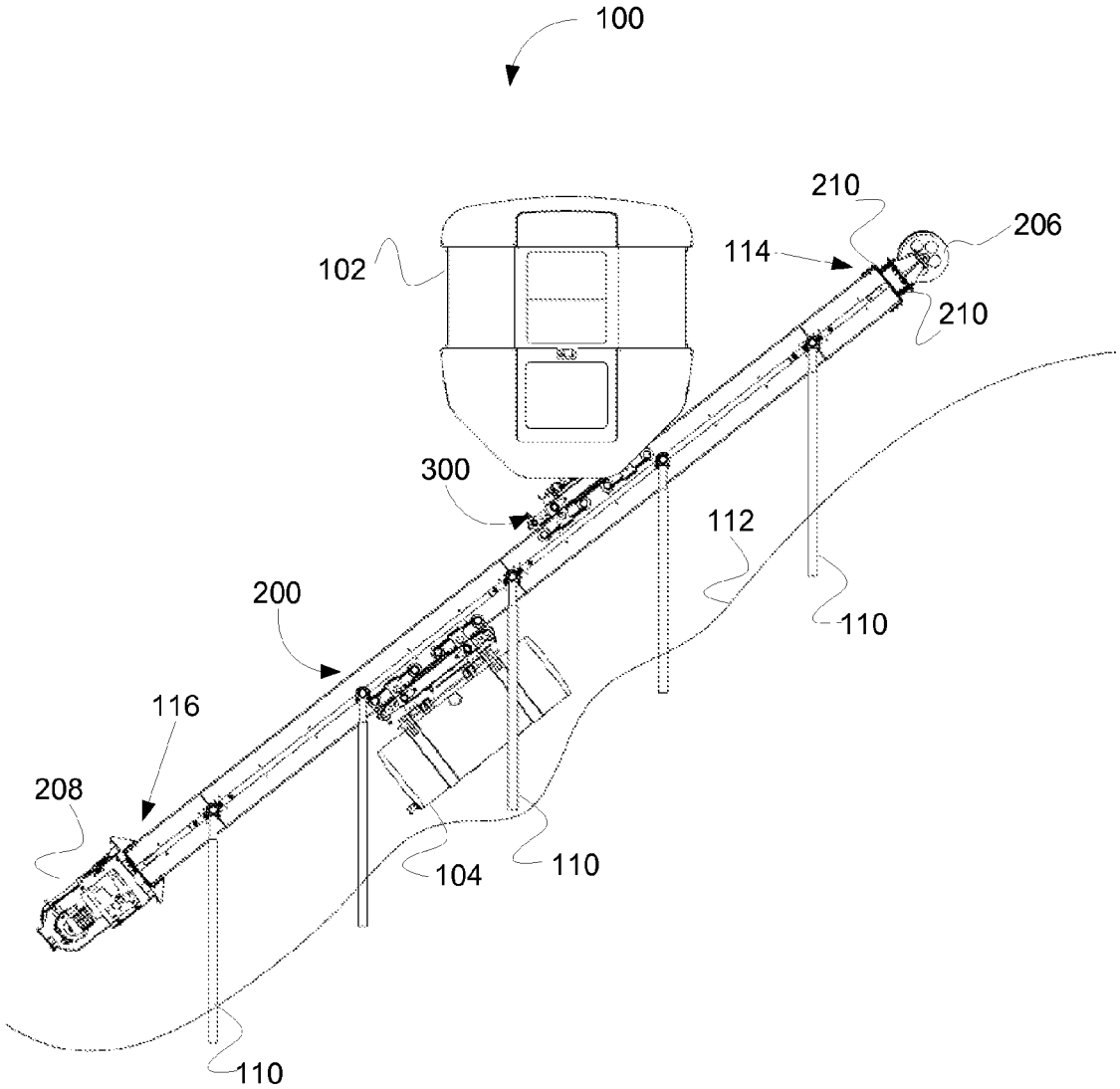
FIGS. 1*a*, 1*b*, and 1*c* are views of an incline elevator, in accordance with an embodiment of the invention.
Figure 1B:
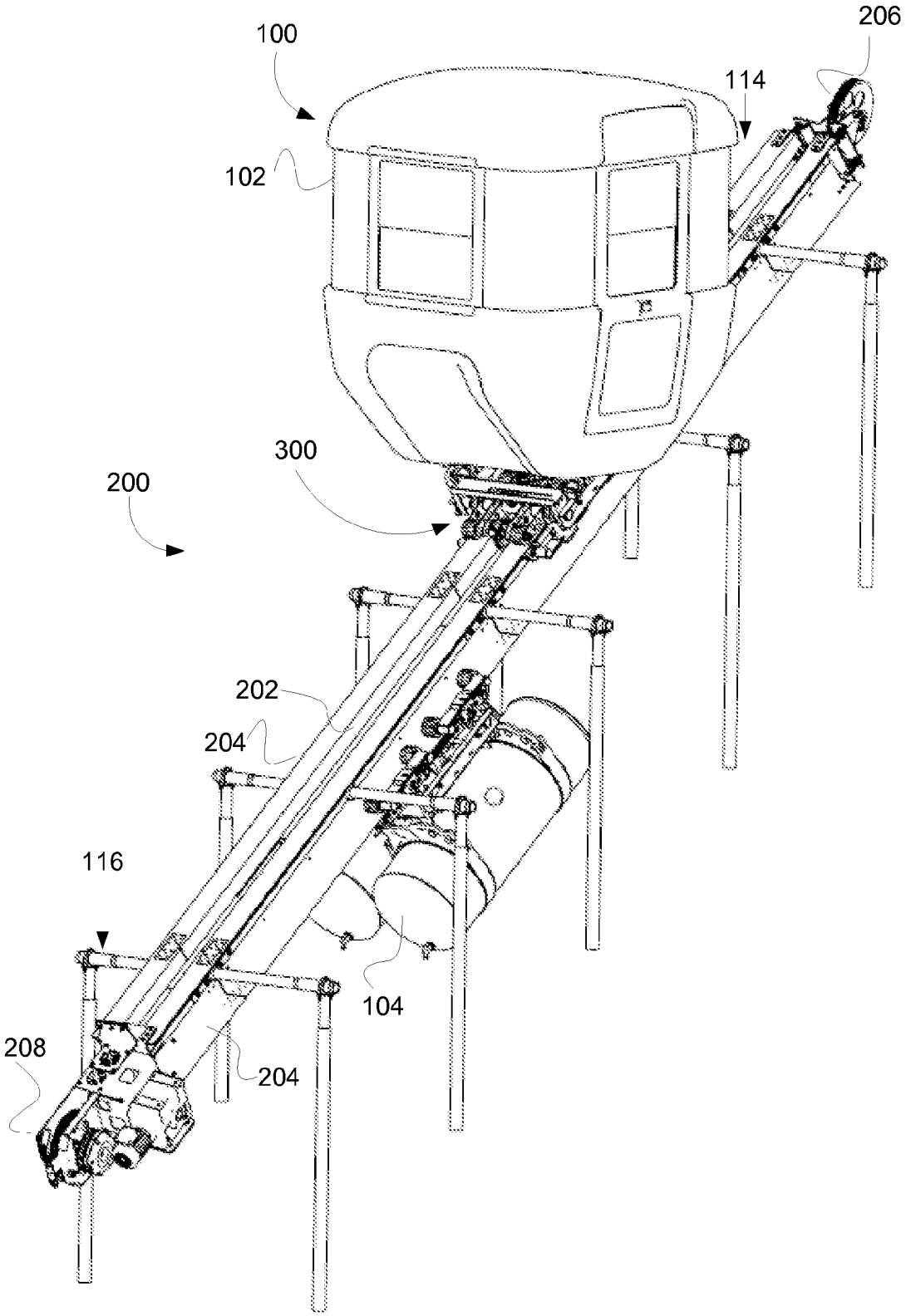
Figure 1C:
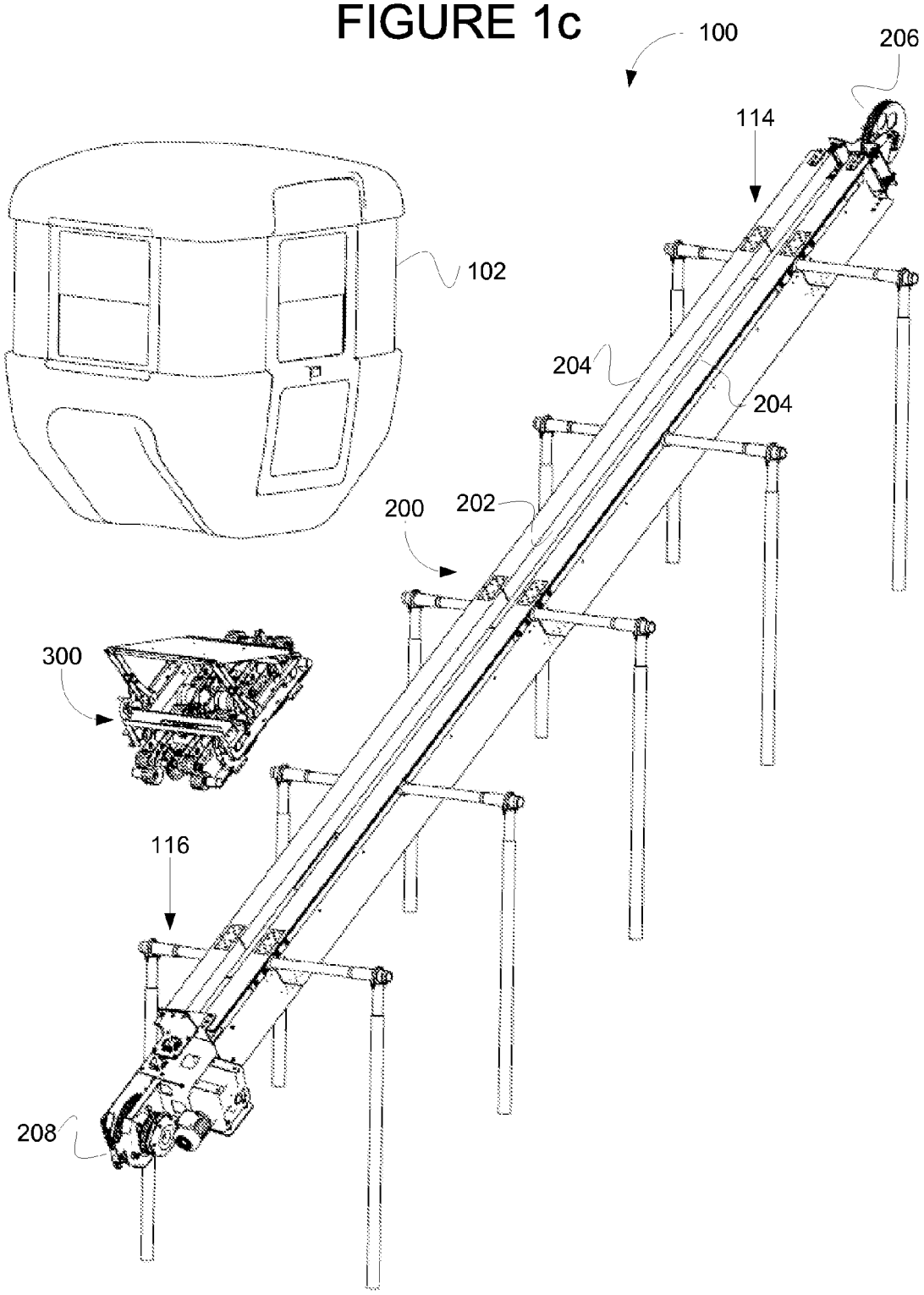

FIGS. 1*a*, 1*b*, and 1*c* are a side view, a perspective view, and an exploded perspective view of an incline elevator, in accordance with an embodiment of the invention. In one embodiment, an incline elevator 100 includes a gondola 102, a counterweight 104, incline mounts 110, an incline 112, an uphill station 114, and a downhill station 116. In this embodiment, an incline elevator 100 further includes a track 200, the track 200 having a channel 202, flanges 204, a pulley 206, and an engine 208. In this embodiment, an incline elevator 100 further includes a load carrying unit 300 and a hoist cable 210.

In some embodiments, a gondola 102 of an incline elevator 100 rests upon and is fixably mounted atop a load carrying unit 300. In a further embodiment, a load carrying unit 300 of an incline elevator travels upon a track 200 of an incline elevator. In some embodiments, a gondola 102 of an incline elevator can be a closed compartment, having a door through which passengers can enter and exit the gondola. In other embodiments, a gondola 102 of an incline elevator can be an open compartment without a roof. In some embodiments, a gondola 102 carries passengers. In other embodiments, a gondola 102 carries cargo. In yet a further embodiment, a gondola 102 is integrated with the load carrying unit 300 of an incline elevator 100. In a further embodiment, an incline elevator does not have a gondola 102, instead moving its load via a load carrying unit 300. It should be recognized by one skilled in the art that a gondola 102 of an incline elevator can serve multiple purposes and be designed to carry any type of load, and that a load carrying unit 300 can carry the load in an alternative embodiment without a gondola 102. Accordingly, a gondola 102 of an incline elevator 100 is not shown in all drawings of the instant disclosure.

In some embodiments, an incline elevator 100 includes a track 200. In some embodiments, a track 200 of an incline elevator 100 is mounted on and along an incline 112. In some embodiments, the incline 112 is outdoors. In different embodiments, the incline 112 is indoors. In a particular embodiment, the grade of the incline 112 is approximately 30 degrees from level. In other embodiments, the grade of the incline 112 varies from 0 degrees to 90 degrees from level. Accordingly, in some embodiments, an incline elevator 100 can run along a track 200 deployed on an incline 112 that is actually a flat surface that is not inclined. In different embodiments, an incline elevator 100 can run along a track 200 deployed perpendicularly to a flat surface, providing a vertical direction of travel of the load.

In some embodiments, the incline 112 is a hill outdoors. In other embodiments, an incline 112 can be a part of a building that is constructed to provide an incline. In yet a different embodiment, an incline 112 can be transportable, as on the back of a flatbed truck.

In some embodiments, the load carrying unit 300 rests on and moves along the top of the track 200. In a different embodiment, the load carrying unit 300 is suspended from the bottom of the track 200, moving along the bottom of the track 200. In a different embodiment, the load carrying unit 300 is suspended a track 200 that is formed from a wire or cable.

In some embodiments, a track 200 of an incline elevator 100 is mounted to the incline 112 using incline mounts 110. In some embodiments an incline mount 110 may be sunk into the ground or otherwise deployed through the surface of the incline 112. In other embodiments an incline mount may be fixably mounted to the surface of the incline 112. In a certain embodiment, the incline mounts 110 vary as needed to provide a uniform grade of incline above a surface with a non-uniform grade of incline. In some embodiments, the incline mounts 112 are solid material. In different embodiments, an incline mount 112 can be formed with one or more legs permitting a counterweight 104 to pass alongside or in between the one or more legs.

In different embodiments, an incline mount may be hydraulically supported and fixably mounted to the surface of the incline 112, thus facilitating differing grades of incline 112 for different height needs during various deployments of an incline elevator 100. In different embodiments, an incline elevator 100 incorporates a track 200 that has curves as the incline elevator 100 ascends the incline 112. It should be recognized by one skilled in the art that an incline elevator 100 can be designed in any orientation, dimension, length, distance, grade, and on any surface whether fixed, or varied, and in a permanent or portable fashion, using differing tracks 200. The instant invention does not limit the scope of its application to any particular implementation of an incline elevator 100. Accordingly, an incline 112 and incline mounts 110 of an incline elevator 100 are not shown in all drawings of the instant disclosure.

In some embodiments, a track 200 of an incline elevator includes an engine 208. In some embodiments, the engine 208 pulls or pushes a hoist cable 210. In some embodiments, a hoist cable 210 circulates along the top and the bottom of the track 200. In a further embodiment, opposing ends of a hoist cable 210 are coupled to opposing ends of a load carrying unit 300. In a further embodiment, a hoist cable is wound around a pulley 206 of the track 200, the pulley 206 being located at the opposite end of the track 200 as the engine 208. In a particular embodiment, the pulling or pushing motion of the engine 208 of the hoist cable 210 imparts movement to a load carrying unit 300 and a gondola 102 of an incline elevator 100. An engine, pulley, and hoist cable system of imparting movement to an elevator system is well understood in the art. Accordingly, an engine, pulley, and hoist cable are not shown in all drawings of the instant disclosure.

In some embodiments, an incline elevator 100 includes a counterweight 104. In a further embodiment, a hoist cable 210 is coupled to a counterweight 104. A counterweight as a part of an elevator system is well understood in the art. Accordingly, a counterweight 104 of an incline elevator 100 is not shown in all drawings of the instant disclosure.

In some embodiments, an incline elevator 100 includes an uphill station 114 and a downhill station 116. In certain embodiments, a station of an incline elevator 100 includes a docking target, the docking target being fixably mounted to a track 200, the docking target being designed to engage or disengage a safety brake of an incline elevator.

In some embodiments, an incline elevator 100 includes a plurality of stations. It should be understood by one skilled in the art that an incline elevator can be constructed with as many stations as desired, and that a station is not required to be located at the top of the track 200, bottom of the track 200, or any other specific location. One or more stations can be located at any place along a track 200 in accordance with embodiments of the invention.

Figure 2A:
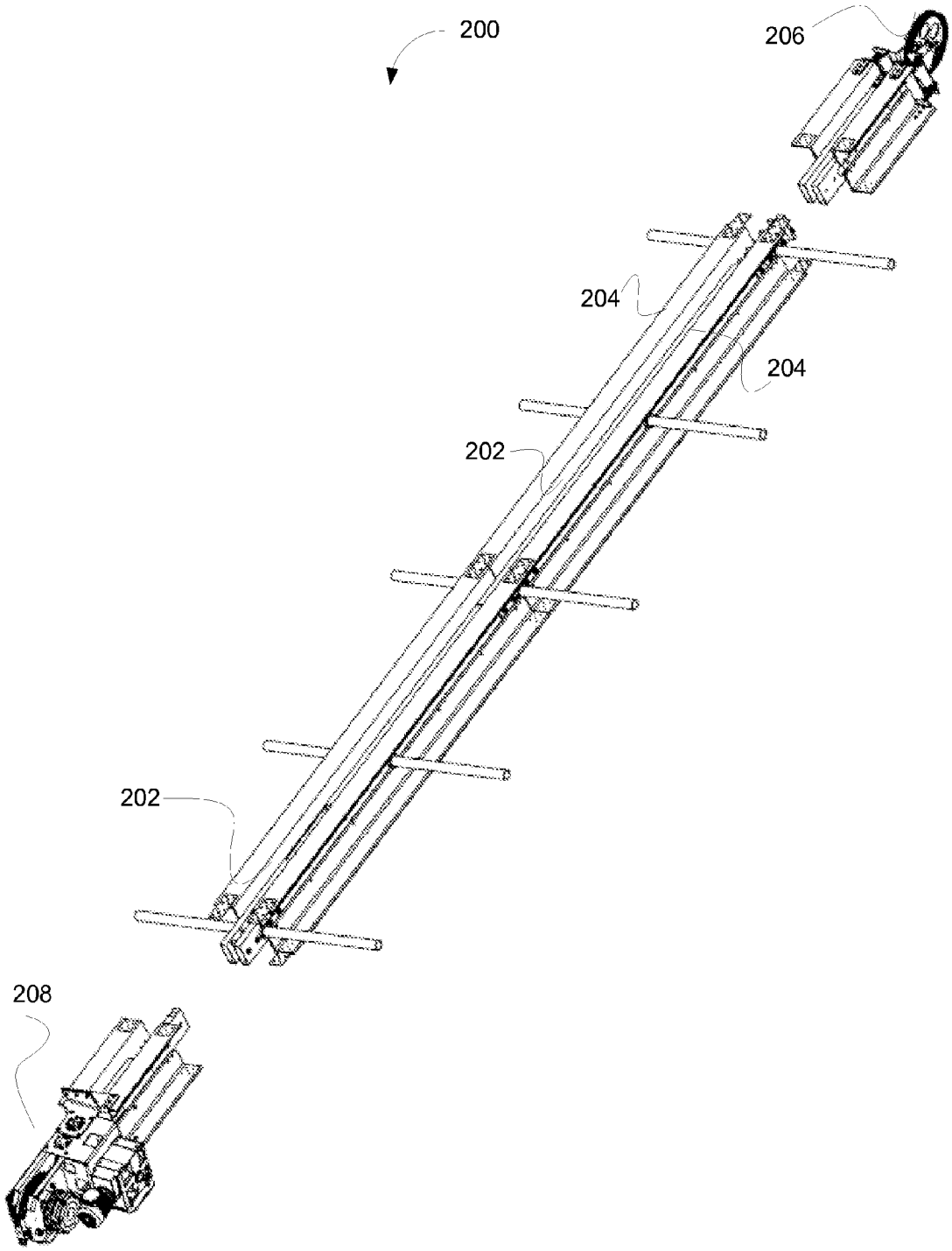
FIGS. 2*a* and 2*b* are views of the track of an incline elevator, in accordance with an embodiment of the invention.
Figure 2B:
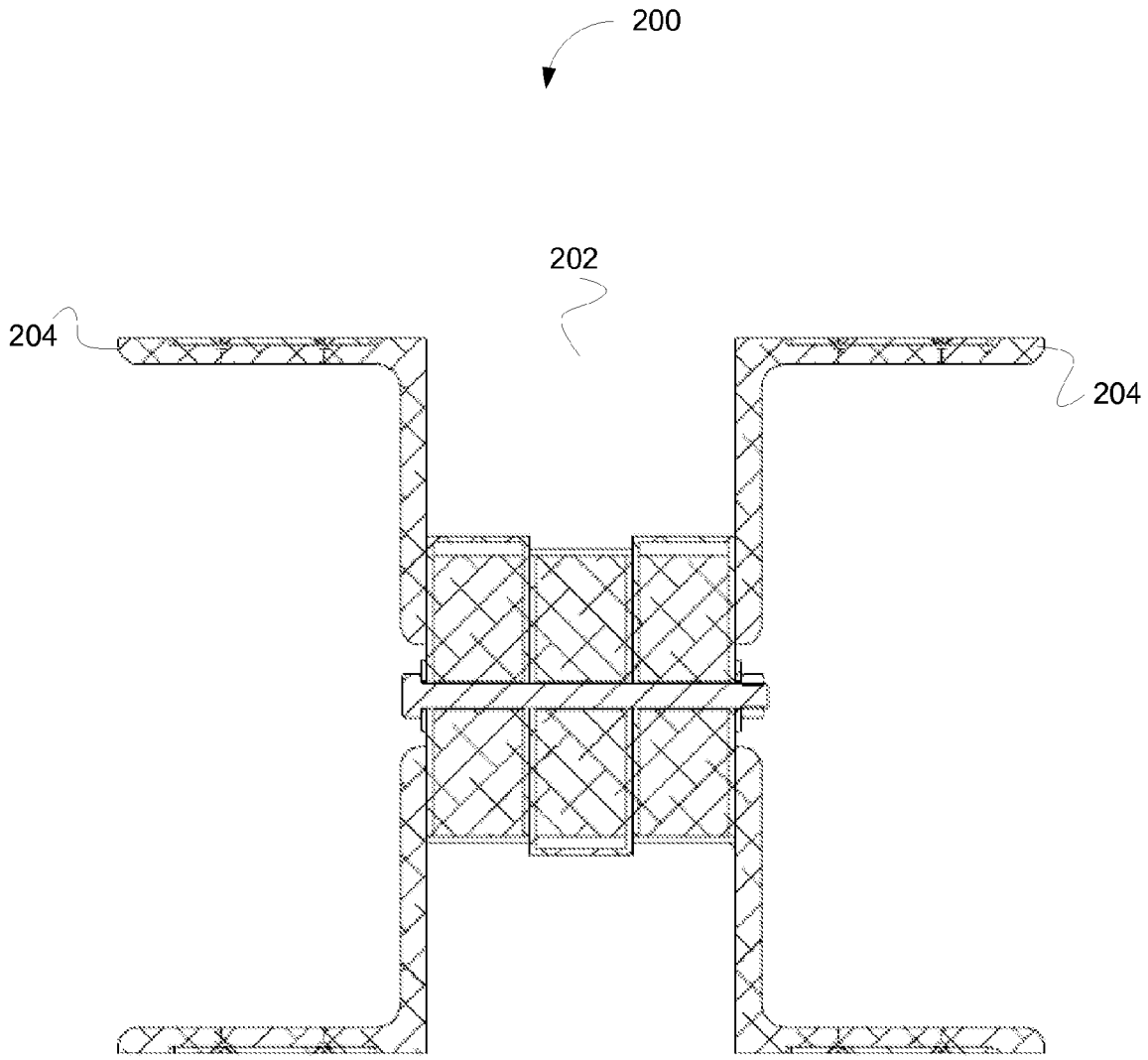

FIGS. 2*a* and 2*b* are an exploded perspective view and a front cross-sectional view of a track 200 of an incline elevator 100, in accordance with an embodiment of the invention. In some embodiments, a track 200 resembles a monorail construction, in which the load rides upon the track 200. In a certain embodiment, a track 200 includes a channel 202 into which at least a portion of a load carrying unit 300 extends, for holding the load carrying unit on top of the track 200 and limiting lateral travel of the load carrying unit 300 (i.e. limiting motion of the load carrying unit 300 in a perpendicular direction to the uphill and downhill directions of the load).

In some embodiments, a track 200 includes flanges 204 to either side of the track 200. In a certain embodiment, top and bottom roller wheels 404 and 406 included in trucks 400 of a load carrying unit 300 glide along flanges 204 of a track 200.

Figure 3A:
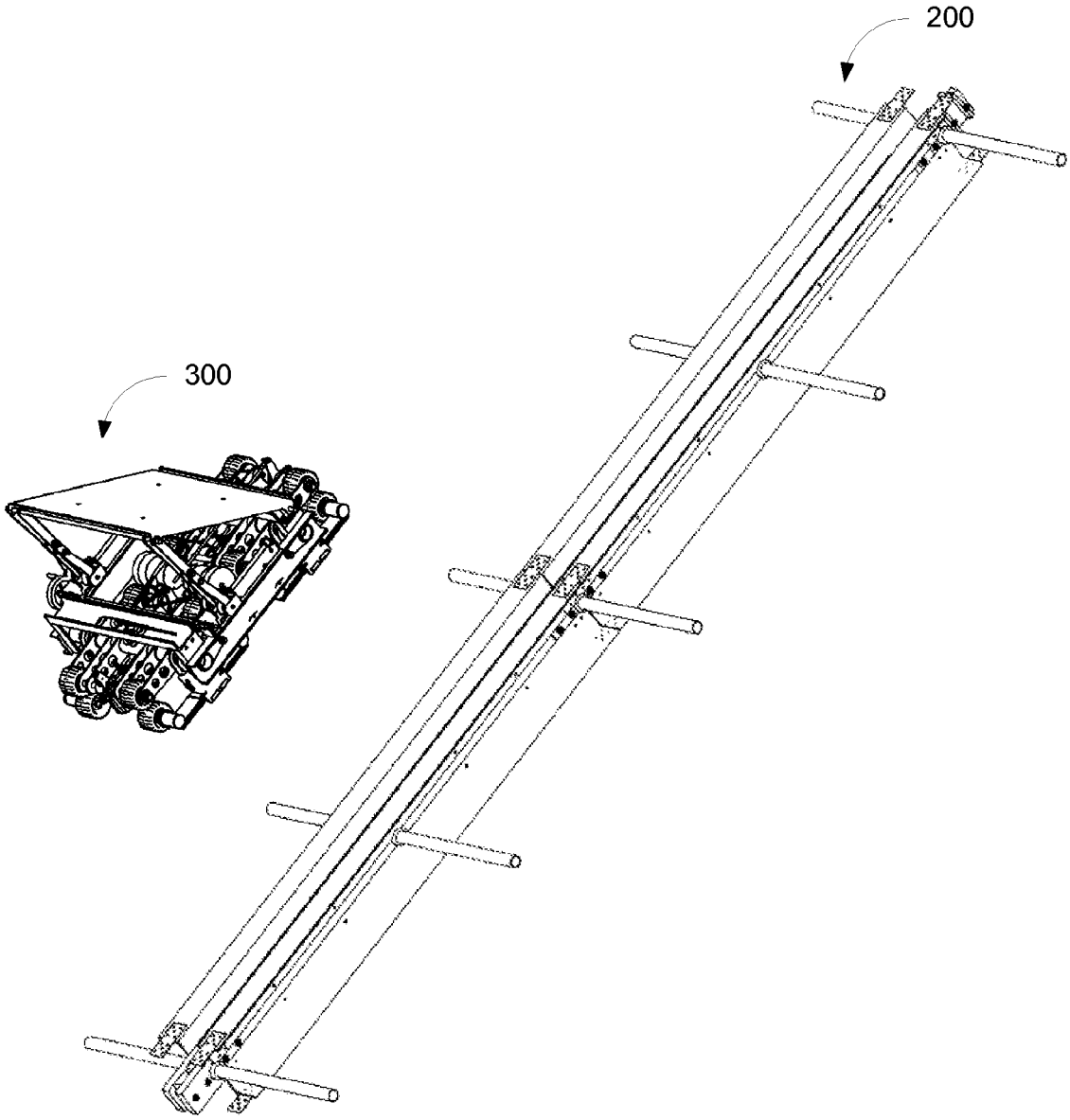
FIGS. 3*a*, 3*b*, 3*c*, and 3*d* are views of a load carrying unit for deployment on a track of an incline elevator, in accordance with an embodiment of the invention.
Figure 3B:
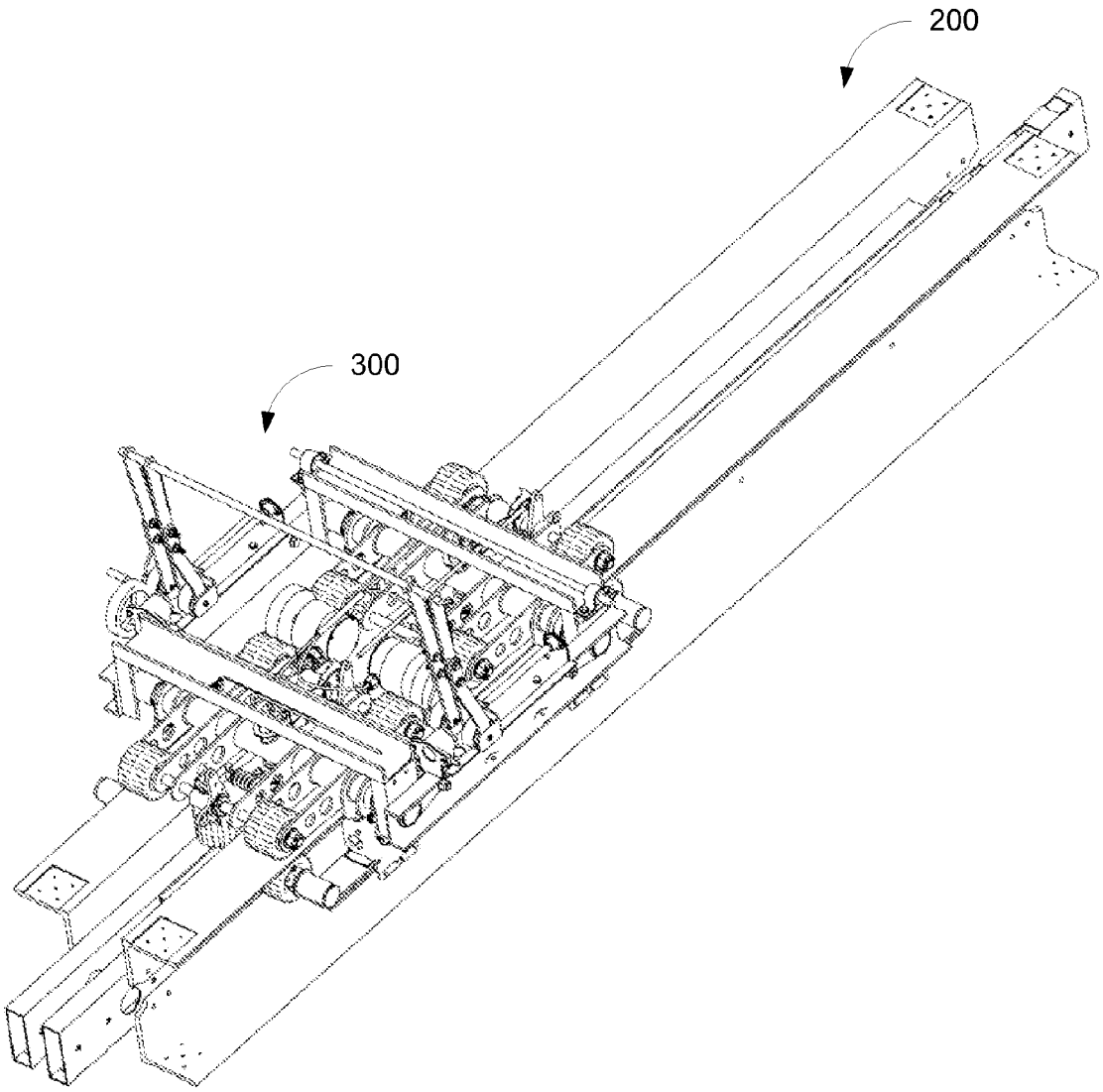
Figure 3C:
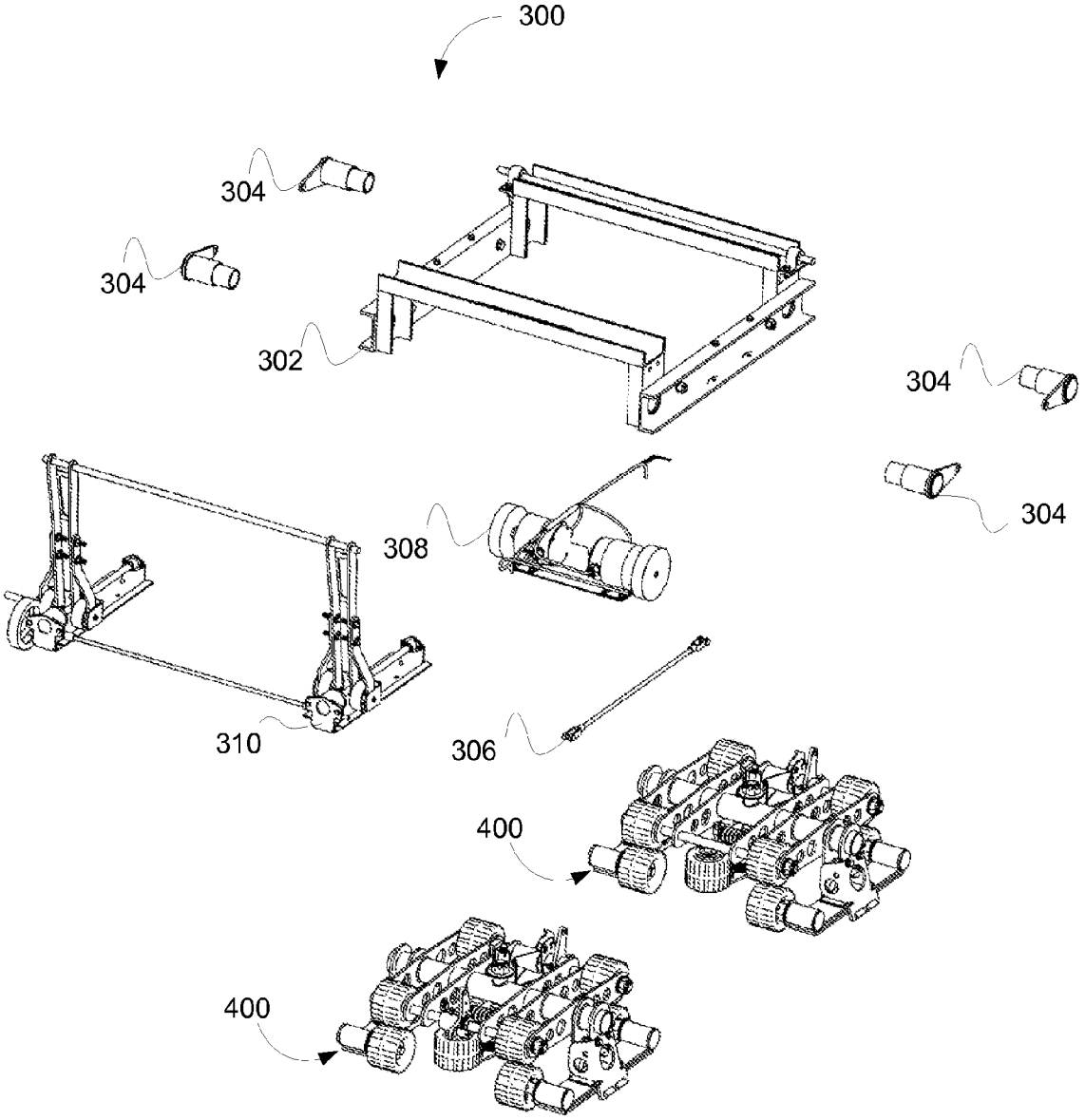
Figure 3D:
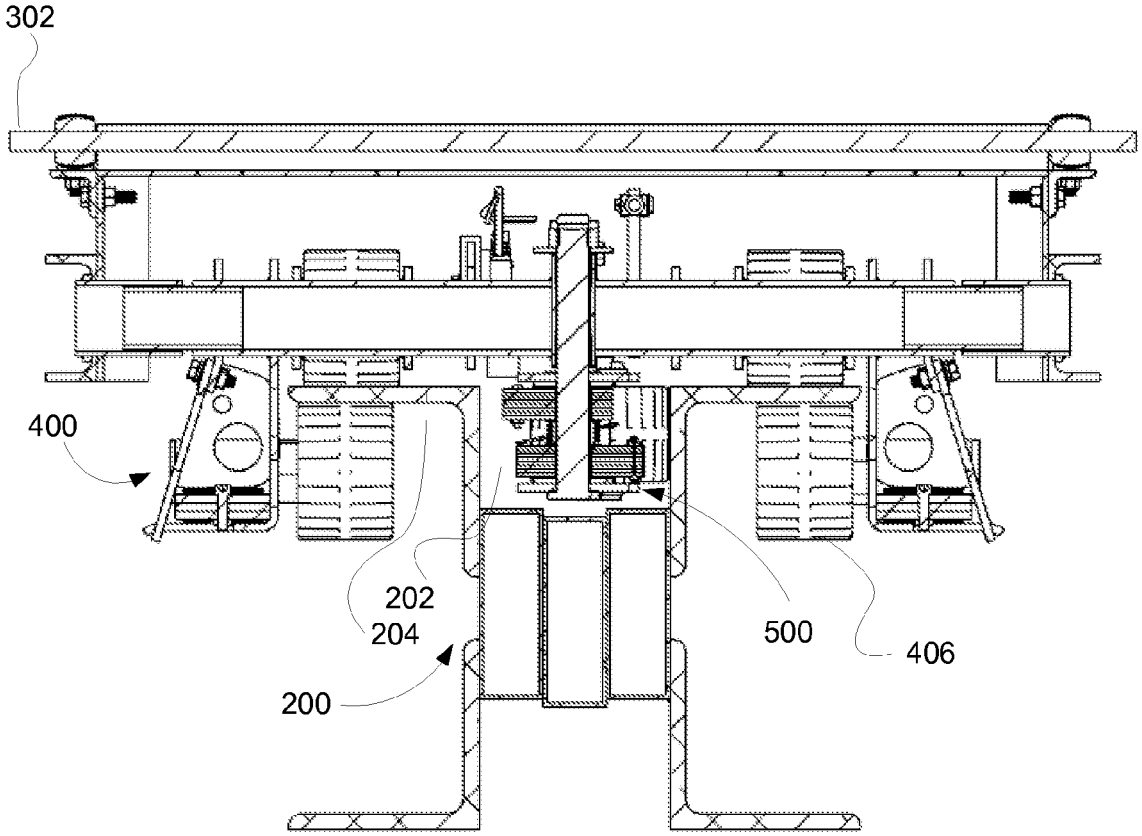

FIG. 3*a* is an exploded perspective view of a load carrying unit 300 for deployment on a track 200 of an incline elevator 100, in accordance with an embodiment of the invention. FIG. 3*b* is a perspective view of a load carrying unit 300 deployed on a track 200 of an incline elevator 100, in accordance with an embodiment of the invention. FIG. 3*c* is an exploded view of a load carrying unit of an incline elevator 100, in accordance with an embodiment of the invention. FIG. 3*d* is a front cross-sectional view of a load carrying unit deployed on a track of an incline elevator, in accordance with an embodiment of the invention. In some embodiments, a load carrying unit 300 moves along a track 200 of an incline elevator 100. In some embodiments, a load carrying unit includes a chassis 302, one or more chassis mounts 304, a safety link 306, a speed sensor 308, a gondola leveling device 310, and one or more trucks 400.

In some embodiments, the one or more chassis mounts 304 are used to attachably couple one or more trucks 400 to a chassis 302. In a further embodiment, a safety link 306 is fixably attached to trucks 400 at opposing ends of a safety link 306. In some embodiments, a gondola leveling device 310 is used where a gondola 102 is mounted atop a chassis 302 of a load carrying unit 300 to level the gondola 310 where a track 200 is not perfectly level with respect to the incline 112. In some embodiments, a speed sensor 308 is mounted on a load carrying unit 300 such that the rotating sensors of the speed sensor 308 are disposed adjacent to one or more top rollers 404 of a truck 400. In some embodiments, the one or more trucks 400 of a load carrying unit 300 are disposed such that the one or more trucks 400 straddle the track 200 of the incline elevator 100. In a certain embodiment, at least a portion of the one or more trucks 400, including one or bottom rollers 406, are disposed below the flange 404 of the track 200 of the incline elevator 100. In a certain embodiment, at least a portion of the one or more trucks 400, including an eccentric safety device 500, is disposed within the channel 202 of the track 200 of an incline elevator 100.

Figure 4A:
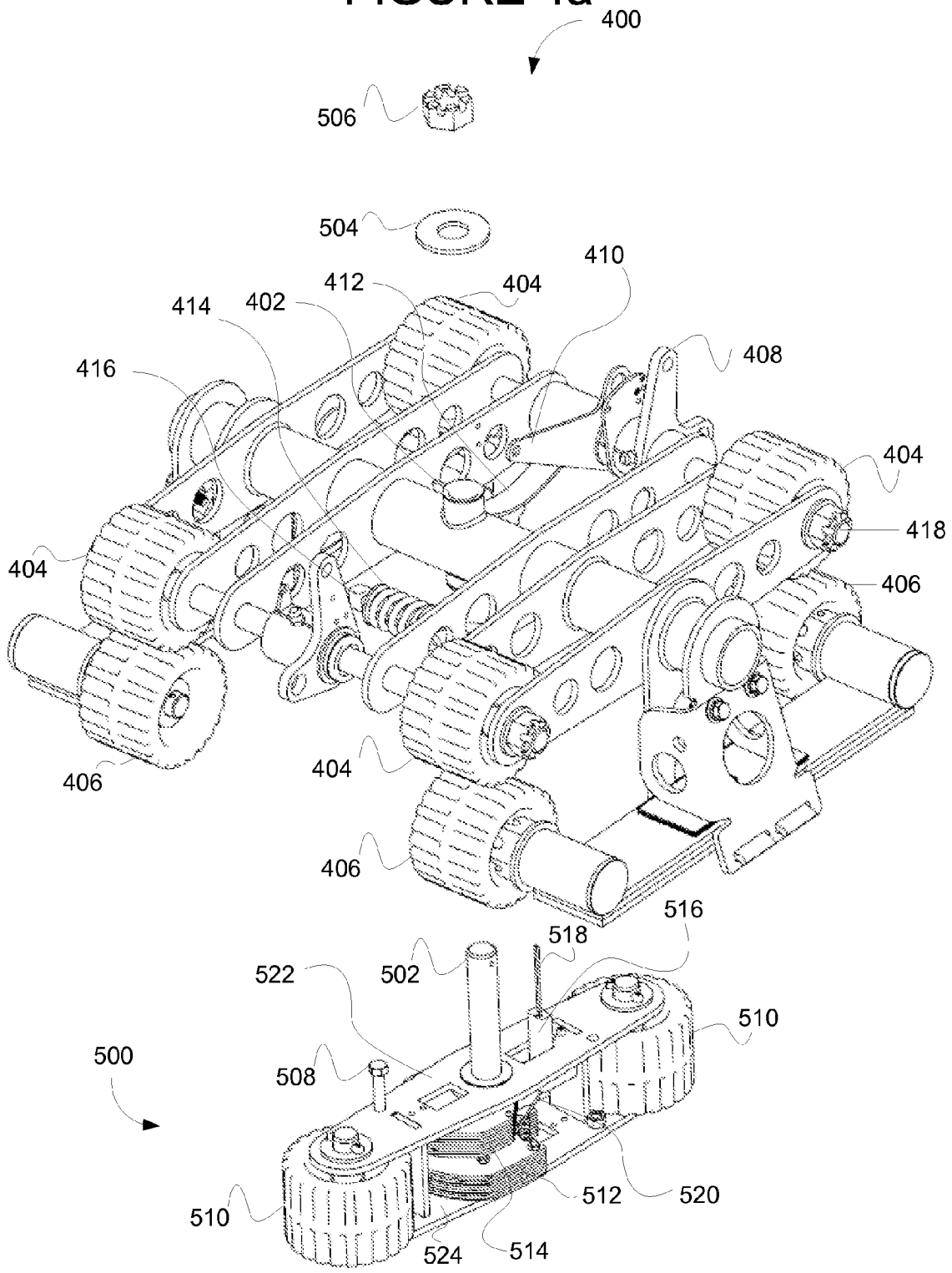
FIGS. 4*a* and 4*b* are views of a truck and eccentric safety device of a load carrying unit for deployment on a track of an incline elevator, in accordance with an embodiment of the invention.
Figure 4B:
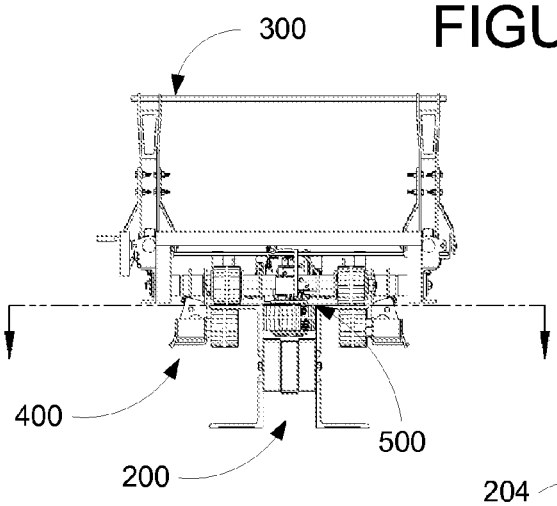
Figure 4B:
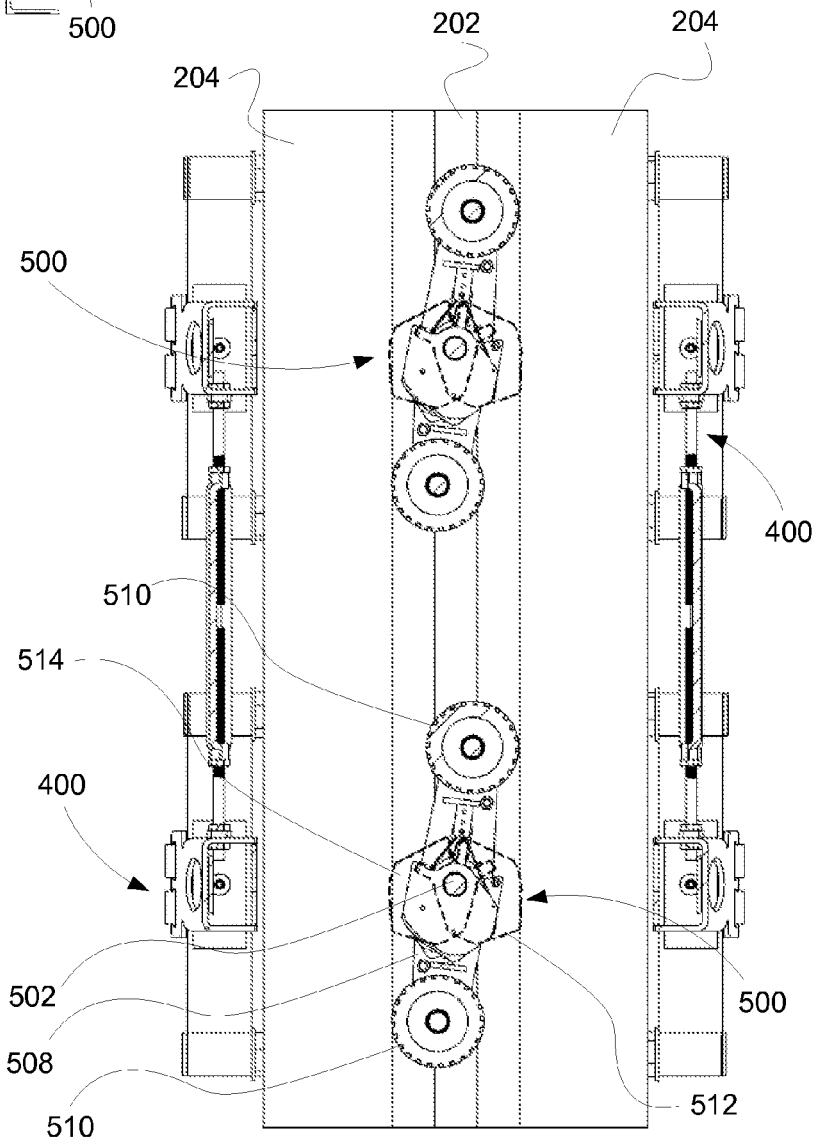

FIG. 4*a* is an exploded detail perspective view of a truck 400 and eccentric safety device 500 of a load carrying unit 300 for an incline elevator 100, in accordance with an embodiment of the invention. FIG. 4*b* is a top cross-sectional view of a truck 400 and eccentric safety device 500 of a load carrying unit 300 deployed on a track 200 of an incline elevator 100, in accordance with an embodiment of the invention. In some embodiments, a truck 400 of a load carrying unit 300 of an incline elevator 100 includes a safety mounting tube 402, one or more top rollers 404, one or more bottom rollers 406, a safety pivot 408, a safety lever 410, a safety reset and docking lever 412, a coil spring 412, a coil spring attachment mount 414, and an eccentric safety device 500. In some embodiments, an eccentric safety device 500 includes a center pin 502, a washer 504, a nut 506, a coil spring pivot 508, one or more guide rollers 510, a bottom eccentric brake 512, a top eccentric brake 514, a brake cable block 516, a brake cable 518, a brake spring 520, an eccentric brake top frame 522, and an eccentric brake bottom frame 524.

In a certain embodiment, an eccentric safety device 500 is couplably attached to a truck 400. In this embodiment, a center pin 502 of an eccentric safety device 500 is disposed through the safety mounting tube 402 of the truck 400. In this embodiment, a nut 506 and washer 504 disposed above the safety mounting tube 402 about the center pin 502 couple the eccentric safety device 500 to the truck 400. In this embodiment, the eccentric safety device 500 is disposed underneath the truck 400 and between the bottom rollers 406 of the truck 400. Importantly, in this embodiment, the eccentric safety device 500 is rotatable about an axis lengthwise through the center pin 502, the rotation of the eccentric safety device 500 being relative to the truck 400.

In some embodiments, an eccentric safety device 500 of a load carrying unit 300 is disposed within the channel 202 of a track 200 of an incline elevator 100. In a certain embodiment, an eccentric safety device 500 is rotatable about an axis lengthwise through the center pin 502, the rotation of the eccentric safety device 500 being limited by the interior of the track 200 formed by the channel 202. In a preferred embodiment, guide rollers 510 on opposing sides of the eccentric safety device 500 are held against the interior of the track 200 by use of a coil spring 414. In this embodiment, the coil spring 414 is coupled at one end of the coil spring 414 to the coil spring pivot 508 of the eccentric safety device 500. In this embodiment, the coil spring 414 is coupled at the opposing end of the coil spring 414 to the coil spring attachment mount 416 of the truck 400. In this embodiment, the coil spring 414 tensionally biases the eccentric safety device 500, such that the eccentric safety device 500 rotates about an axis lengthwise through the center pin 502, the rotation being limited by the guide rollers 510 of the eccentric safety device 500 which are pressed up against the interior surface of the channel 202 of the track 200. In this embodiment, the spring tension of the coil spring 414 between the eccentric safety device 500 and the one or more trucks 400 of the load carrying unit 300 tensionally biases the load carrying unit 300 such that the load carrying unit 300 remains centered on the track 200. In this embodiment, the rotation of the eccentric safety device 500 relative to the trucks 400 enable the load carrying unit 300 to be used with tracks 200 having differing widths of channel 202, or having varied widths of the channel 202 within the same track 200, or keeping the load carrying unit 300 centered on the track 200 even when the track 200 is a curved track.

In some embodiments, a bottom eccentric brake 512 and a top eccentric brake 514 are couplably mounted on a center pin 502 of an eccentric safety device 500. In this embodiment, the center pin 502 is disposed through a hole in the bottom eccentric brake 512 and the top eccentric brake 514. In such an embodiment, a brake spring 520 tensionally biases the eccentric brakes (the "eccentric brakes" comprising the bottom eccentric brake 512 and the top eccentric brake 514) such that they are rotatable about an axis lengthwise through the center pin 502. In this embodiment, the eccentric brakes can swing out and make contact with the interior surface of the channel 202 of the track 200. FIG. 4*b* depicts that in this embodiment, in dashed lines the bottom eccentric brake 512 and the top eccentric brake 514 have swung out to make contact with the interior of the channel 202 of the track 200. In this embodiment, the brake spring 520 tensionally biases the eccentric brakes outwardly from the eccentric safety device, such that they make contact with the interior surface of the channel 202 of the track 200.

In this embodiment, the contact between the eccentric brakes and the channel 202 creates sufficient friction to stop any movement of the load carrying unit 300 to which the eccentric safety device 500 and its truck 400 are mounted. Importantly, in this embodiment, it is movement in a downhill direction that is arrested by the eccentric brakes. In this embodiment, even when the eccentric brakes are tensionally biased outward to make contact with the interior of the channel 202, the shape of the eccentric brakes in conjunction with the tension of the brake spring 520 are such that the load carrying unit 300 can be towed in an uphill direction along the track 200. In this embodiment, the contact between the eccentric brakes and the interior of the channel 202 only arrests travel in a downhill direction.

Figure 5A:
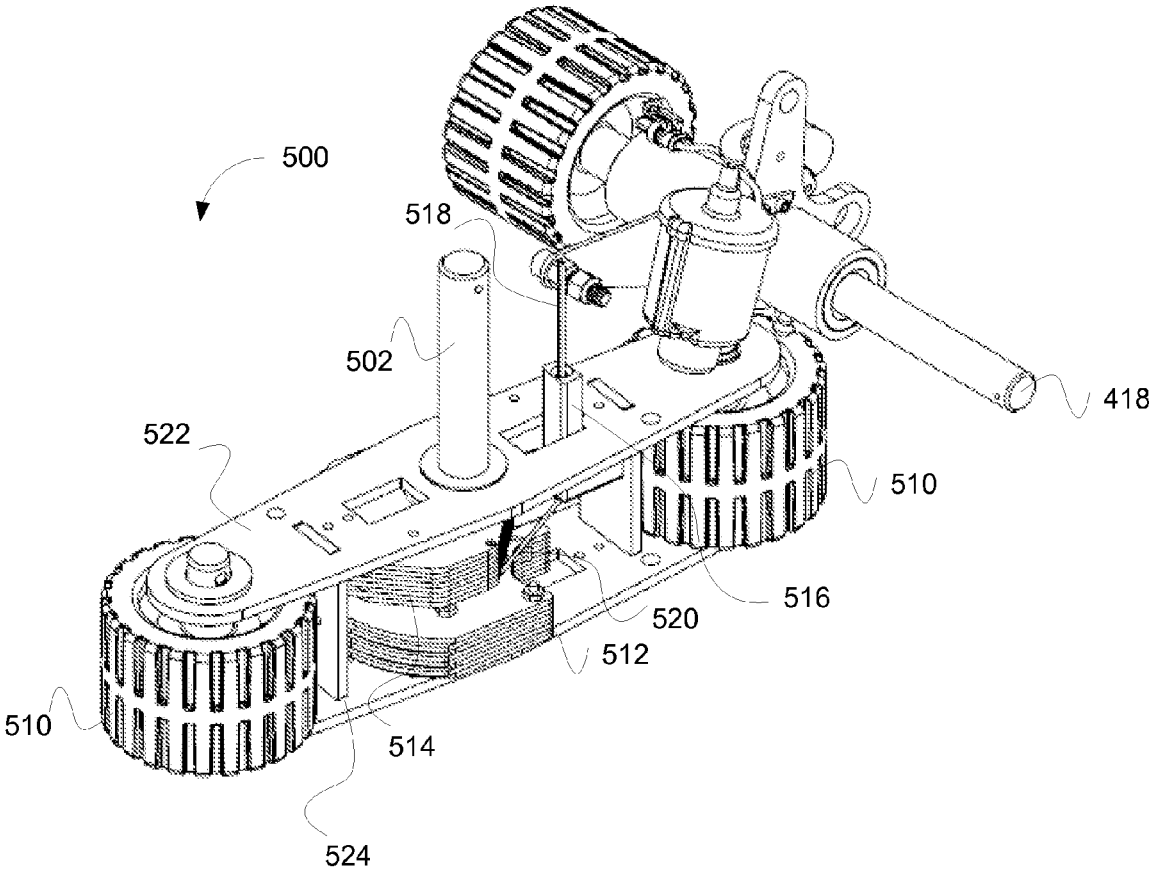
FIGS. 5*a*, 5*b*, 5*c*, 5*d*, 5*e*, and 5*f* are views of an eccentric safety device of an incline elevator, in accordance with an embodiment of the invention.

FIG. 5*a* is a perspective view of an eccentric safety device 500 of an incline elevator 100, in accordance with an embodiment of the invention. In one embodiment, an eccentric safety device 500 includes a center pin 502, one or more guide rollers 510, an top eccentric brake 512, a bottom eccentric brake 514, a brake cable block 516, a brake cable 518, a brake spring 520, an eccentric brake top frame 522, and an eccentric brake bottom frame 524.

Figure 5B:
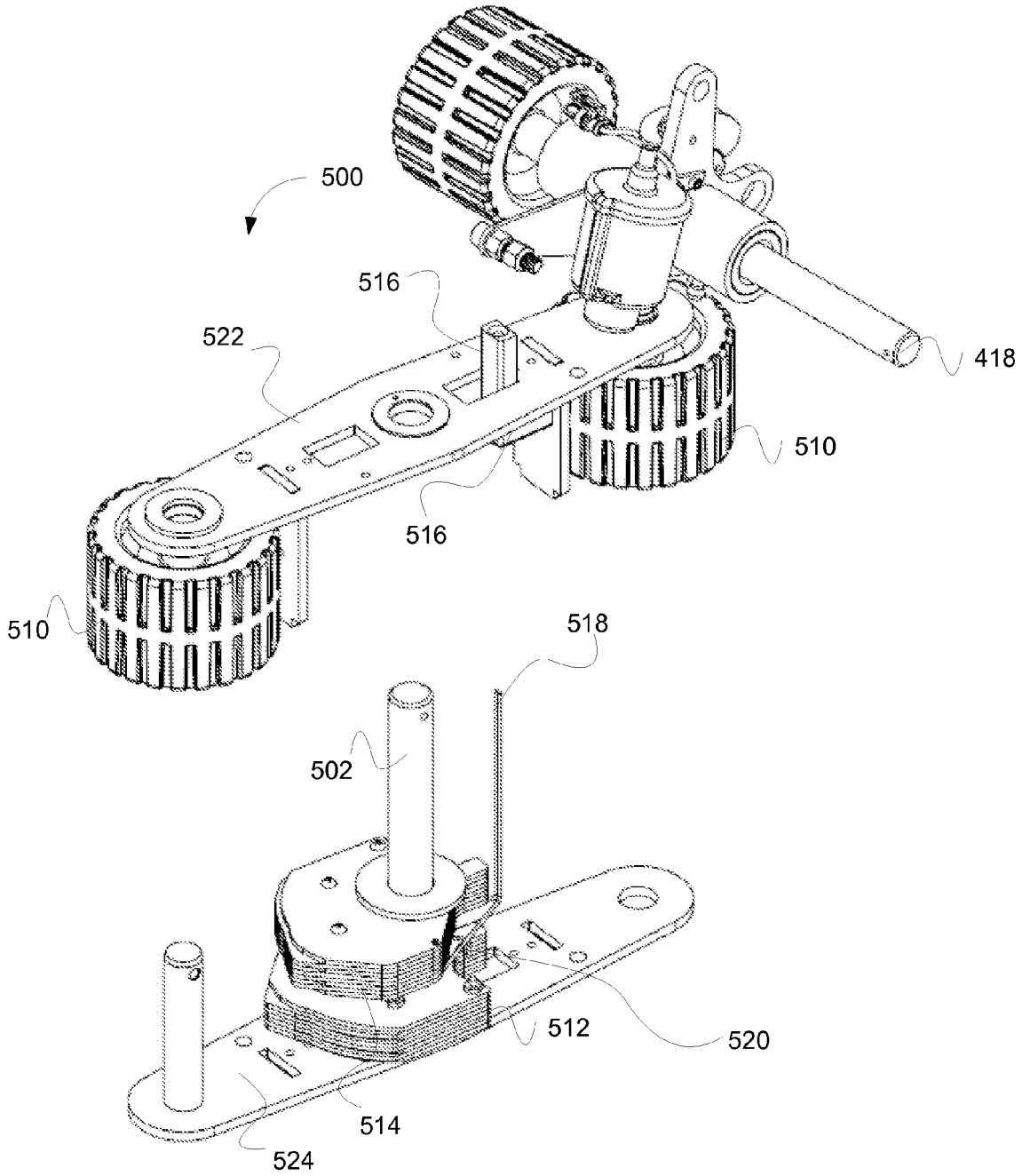

FIG. 5*b* is an exploded perspective view of an eccentric safety device 500 of an incline elevator 100, in accordance with an embodiment of the invention. In a certain embodiment, a bottom eccentric brake 512 and a top eccentric brake 514 are couplably mounted on a center pin 502 of an eccentric safety device 500. In this embodiment, the center pin 502 is disposed through a hole in the bottom eccentric brake 512 and the top eccentric brake 514. In such an embodiment, a brake spring 520 tensionally biases the eccentric brakes (the "eccentric brakes" comprising the bottom eccentric brake 512 and the top eccentric brake 514) such that they are rotatable about an axis lengthwise through the center pin 502. In this embodiment, with no tension applied to the brake cable 518, the brake spring 520 tensionally biases the eccentric brakes to swing outward and extend further outside the periphery of the eccentric brake bottom frame 522, as depicted by the dashed lines in FIG. 5*f* which show the eccentric brakes in an extended position. In this embodiment, a force pulling upward on the brake cable 518 will counteract the tensional bias of the brake spring 520 and cause the eccentric brakes to swing back into retracted position, as depicted by the solid lines of the eccentric brakes in FIG. 5*f*.

Figure 5C:
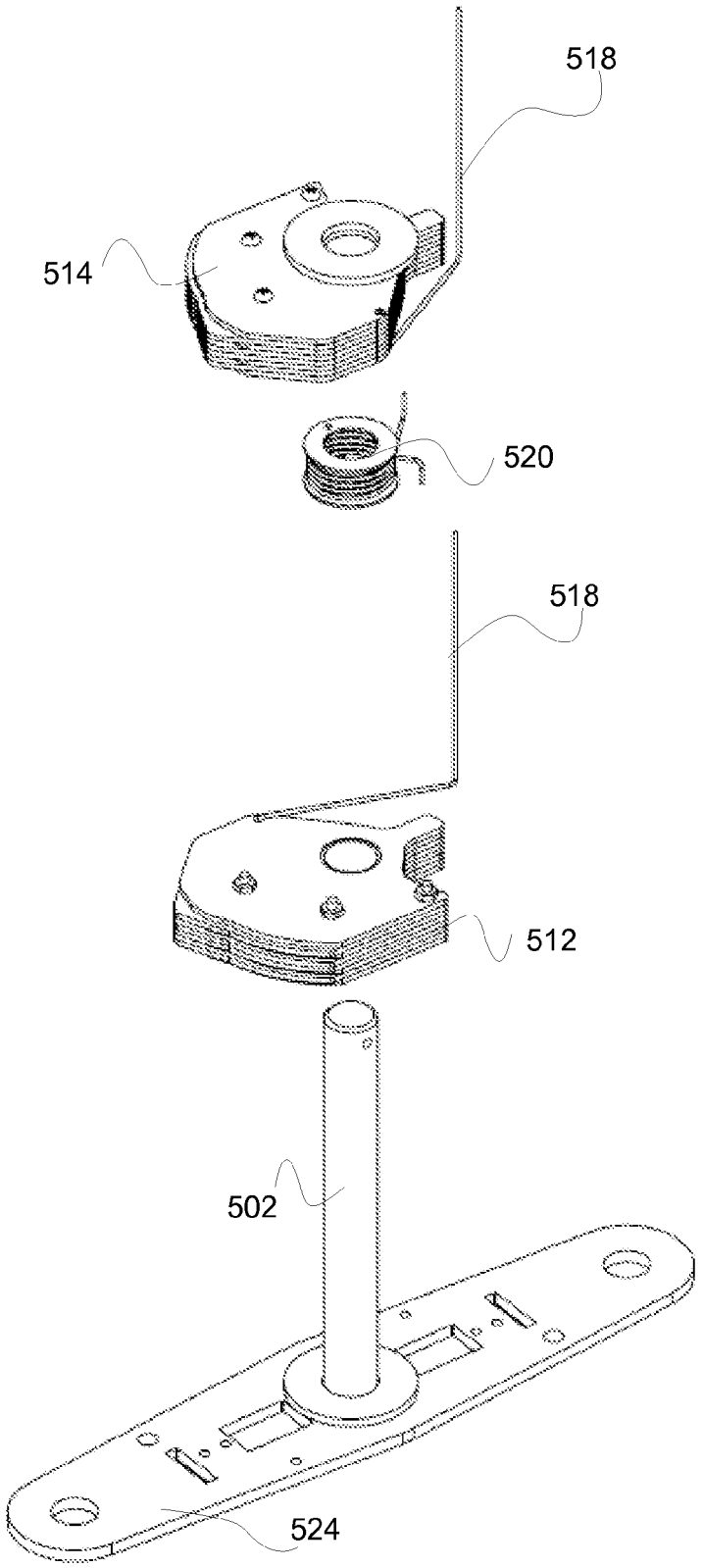

FIG. 5*c* is an exploded perspective view of a portion of an eccentric safety device 500 of an incline elevator 100, in accordance with an embodiment of the invention. In a certain embodiment, stacked up the eccentric brake bottom frame 524 and its center pin 502 are a bottom eccentric brake 512, a brake spring 520, and a top eccentric brake 514. In this embodiment, the ends of the wire forming the brake spring 520 are bent in opposing directions. In this embodiment, when the eccentric safety device 500 is assembled, the ends of the brake spring 520 hook the eccentric brakes and tensionally bias the eccentric brakes to rotate about the center pin 502 outwardly, in an extended position that brings the brakes further outside the periphery of the eccentric brake bottom frame 524. In this embodiment, a force applied upwards on the brake cable 518, that is, a force applied in a direction away from the eccentric brake bottom frame 524, will add tensional bias to the brake spring 520, causing the eccentric brakes to swing inward into a retracted position. Releasing force applied to the brake cable 518 will permit the spring tension of the brake spring 520 to swing the eccentric brakes outward into the extended position.

Figure 5D:
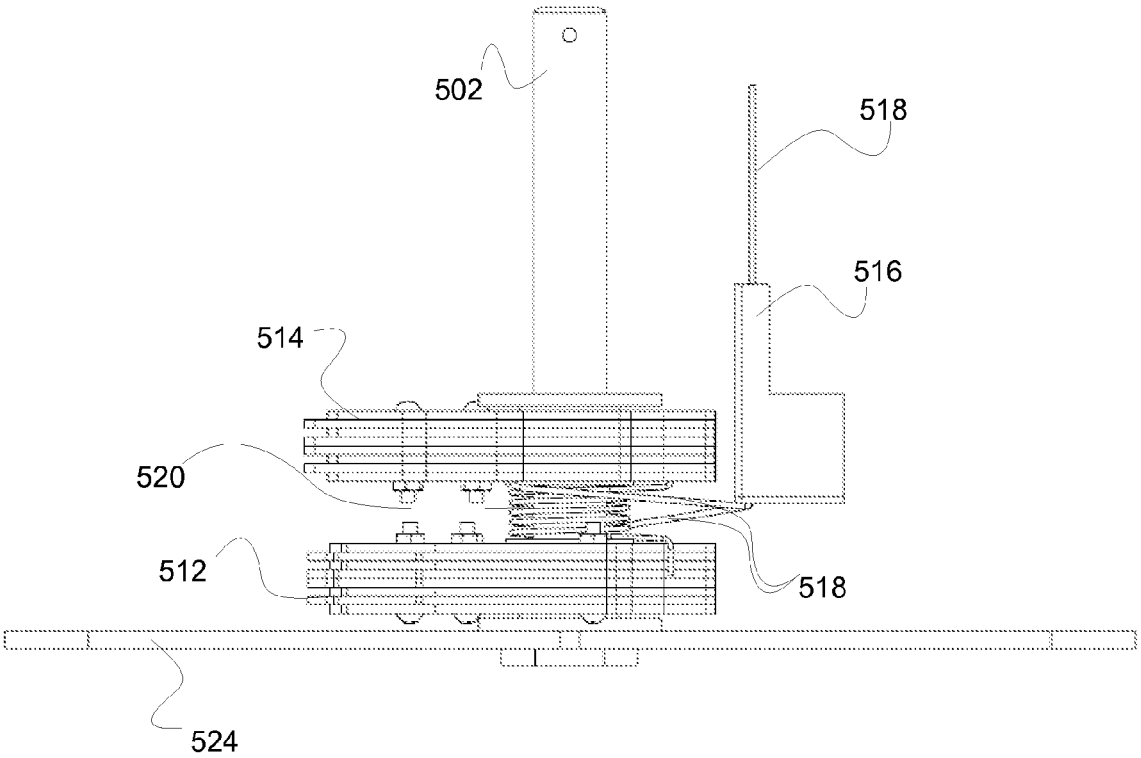

FIG. 5*d* is a side view of a portion of an eccentric safety device 500 of an incline elevator 100, in accordance with an embodiment of the invention. In this embodiment, the brake cable 518 is threaded through a brake cable block 516. In this embodiment, a brake cable 518 has two strands, one strand coupled to each eccentric brake. In this embodiment, when an upward force is applied to the brake cable 518, the eccentric brakes swing towards the periphery of the eccentric brake bottom frame 524, into a retracted position. When force is released from the brake cable 518, tension in the brake spring 520 causes the eccentric brakes to swing out, rotating about the center pin 502, into an extended position such that the eccentric brakes extend outside the periphery of the eccentric brake bottom frame 524.

Figure 5E:
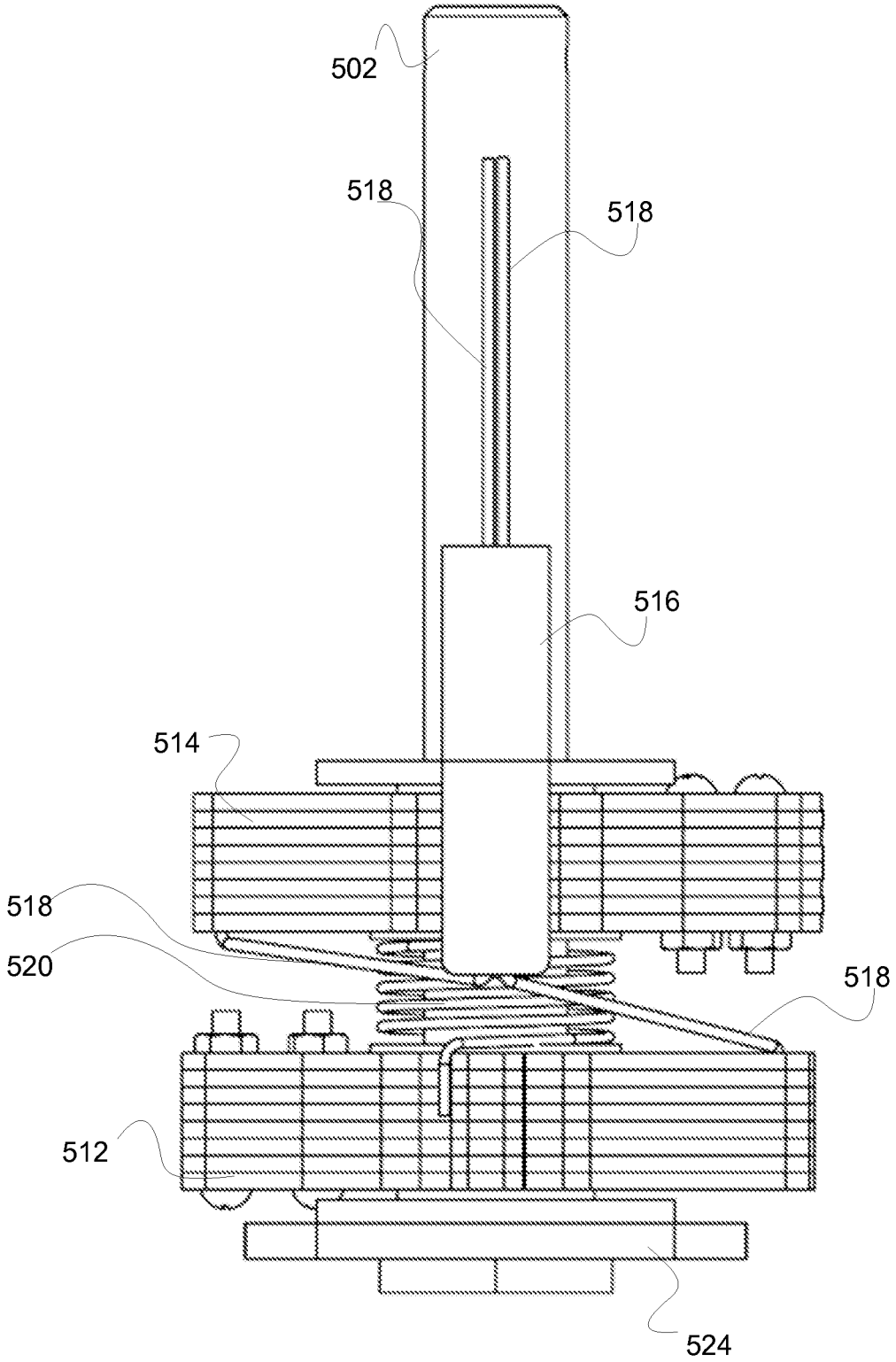

FIG. 5*e* is a rear view of a portion of an eccentric safety device 500 of an incline elevator 100, in accordance with an embodiment of the invention. In this embodiment, the brake cable 518 is threaded through a brake cable block 516. In this embodiment, a brake cable 518 has two strands, one strand coupled to each eccentric brake. In this embodiment, when an upward force is applied to the brake cable 518, the eccentric brakes swing towards the periphery of the eccentric brake bottom frame 524, into a retracted position. When force is released from the brake cable 518, tension in the brake spring 520 causes the eccentric brakes to swing out, rotating about the center pin 502, into an extended position such that the eccentric brakes extend outside the periphery of the eccentric brake bottom frame 524.

Figure 5F:
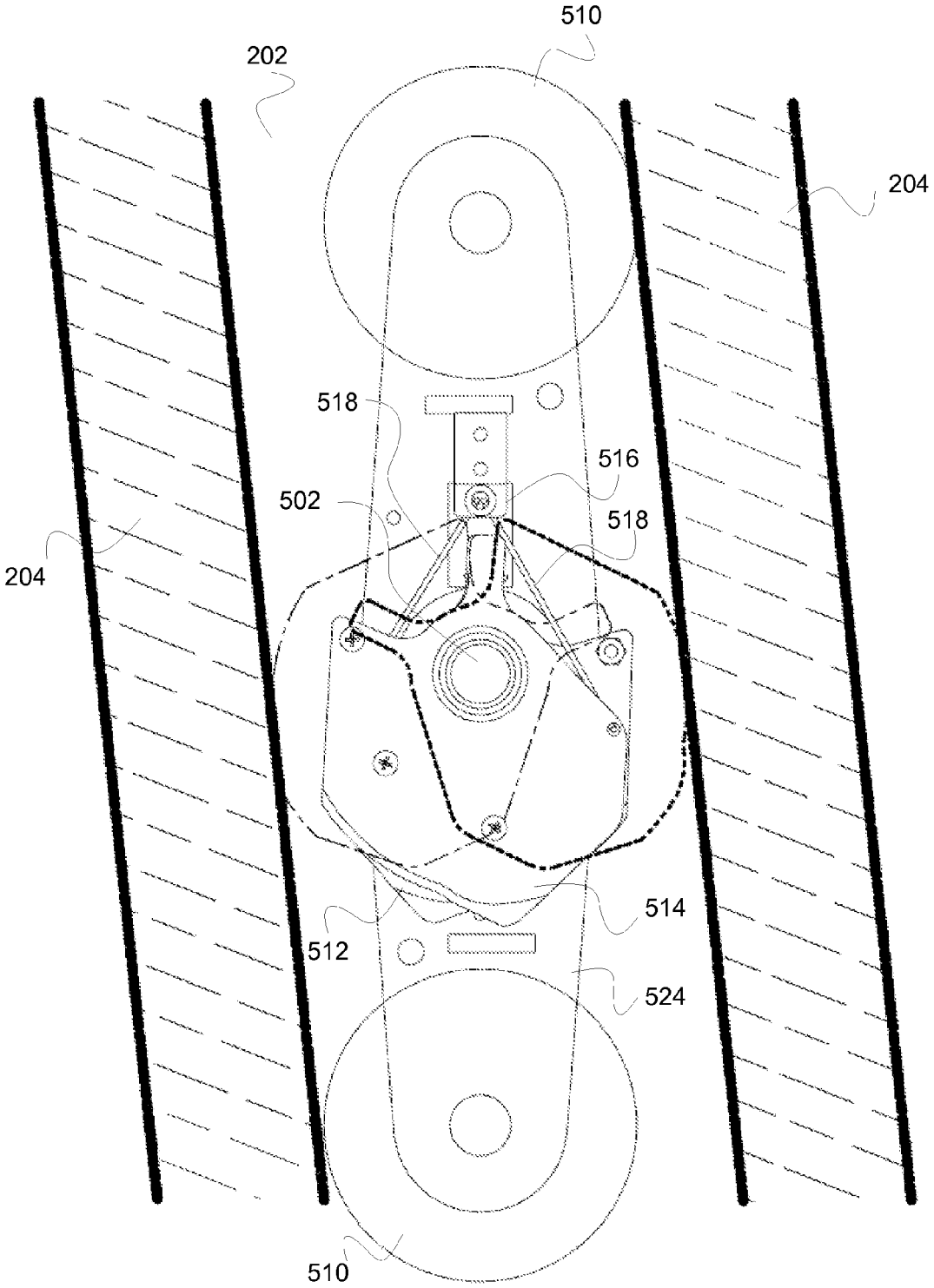

FIG. 5*f* is a top cross-sectional view of an eccentric safety device 500 deployed on a track 200 of an incline elevator 100, in accordance with an embodiment of the invention. In this embodiment, when cable tension in the brake cable 518 is released, the eccentric brakes swing out, rotating about the center pin 502. In this embodiment, looking down at the eccentric brakes disposed within the channel 202, when the brake cable is released, the bottom eccentric brake 512 swings to the right, rotating counterclockwise about the center pin 502, and the top eccentric brake 514 swings to the left, rotating clockwise about the center pin 502. In this embodiment, the movement imparted to the eccentric brakes is driven by tensional bias in the brake spring 520. In this embodiment, when the eccentric brakes swing out, they come into contact with the inner walls of the channel 202 of the track 200 of the incline elevator 100, the eccentric brakes in their extended position being depicted by dashed lines.

In this embodiment, when an upward force is applied to the brake cable 518, the eccentric brakes swing in, rotating about the center pin 502. In this embodiment, looking down at the eccentric brakes disposed within the channel 202, when the brake cable is pulled, the bottom eccentric brake 512 swings to the left, rotating clockwise about the center pin 502, and the top eccentric brake 514 swings to the right, rotating counterclockwise about the center pin 502. In this embodiment, the movement imparted to the eccentric brakes is driven by the pulling force on the brake cable 518, and adds tension to the brake spring 520. In this embodiment, when the eccentric brakes swing in, they break contact with the inner walls of the channel 202 of the track 200 of the incline elevator 100, the eccentric brakes in their retracted position being depicted by solid lines.

Figure 6A:
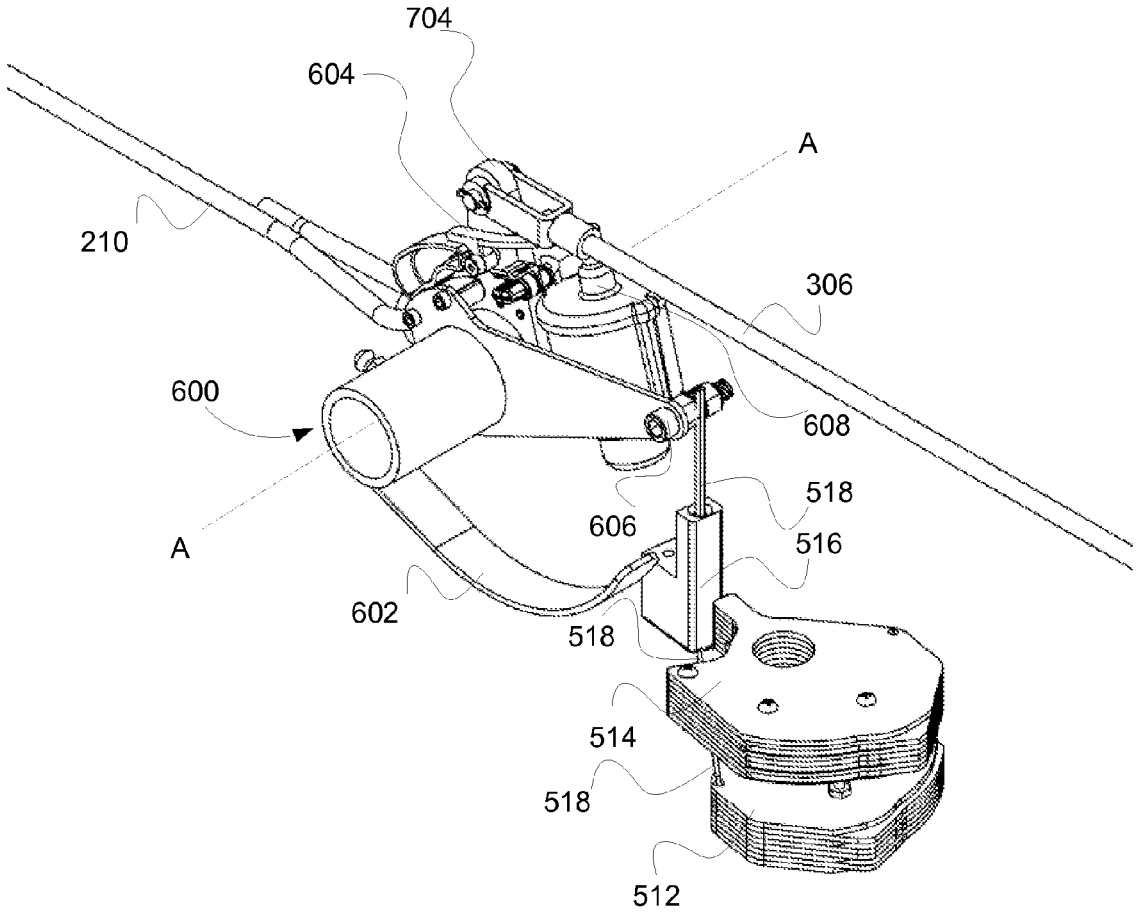
FIGS. 6*a* and 6*b* are views of an eccentric bell crank for an eccentric safety device of an incline elevator, in accordance with an embodiment of the invention.

FIG. 6*a* is a perspective view of an eccentric bell crank 600 for an eccentric safety device 500 of an incline elevator 100, in accordance with an embodiment of the invention. In some embodiments, an eccentric bell crank 600 includes a docking lever 602, a solenoid lever 604, and an eccentric bell crank brake cable mount 606. In a certain embodiment, an eccentric bell crank 600 is coupled with a brake cable 518 at the eccentric bell crank brake cable mount 606. In a certain embodiment, an eccentric bell crank 600 rotates about axis AA. In this embodiment, axis AA is the center lengthwise axis of an axle 418 of a truck 400. An eccentric bell crank 600 is mounted to a truck 400 along an axle 418 of the truck 400 by being threaded onto the outside of one axle 418 of the truck 400. That is, the axle 418 of the truck 400 passes through the eccentric bell crank 600 along axis AA.

In this embodiment, when the eccentric bell crank 600 rotates about axis AA, motion is imparted to the brake cable 518 which is connected to the eccentric bell crank 600 at the eccentric bell crank brake cable mount 606. In this embodiment, when the eccentric bell crank 600 is rotated about axis AA, the motion imparted to the brake cable 518 also imparts motion to the eccentric brakes. In this embodiment, when the eccentric bell crank 600 rotates counter-clockwise as viewed in this drawing, such that the brake cable 518 is pulled upwards relative to the eccentric brakes, the bottom eccentric brake 512 swings to the left and the top eccentric brake 514 swings to the right, against the spring tension imparted to the eccentric brakes by the brake spring 520 (not visible in FIG.

6*a*), and retracting the eccentric brakes. In this embodiment, when the eccentric bell crank 600 rotates clockwise as viewed in this drawing, the brake cable 518 moves in a downward direction towards the eccentric brakes, permitting the spring tension in the brake spring 520 to extend the eccentric brakes, with the bottom eccentric brake 512 swinging to the right and the top eccentric brake 514 swinging to the left.

In some embodiments, a solenoid 608 engages and imparts motion to an eccentric bell crank 600. In a further embodiment, an eccentric bell crank 600 is rotated when contact is made with either the docking lever 602 of the eccentric bell crank 600, or with the solenoid lever 604. In this embodiment, contact with either the docking lever 602 or the solenoid lever 604 rotates the eccentric bell crank 600 counter-clockwise about axis AA, moving eccentric bell crank brake cable mount 606 away from the eccentric brakes. In this embodiment, contact with either the docking lever 602 or the solenoid lever 604 imparts motion to the eccentric brakes, pulling the brake cable 518 and retracting the eccentric brakes. Importantly, in this embodiment, engaging the eccentric bell crank 600 with either the docking lever 602 or the solenoid lever 604 retracts the eccentric brakes. In this embodiment, if neither the docking lever 602 nor the solenoid lever 604 are engaged, the spring tension in the brake spring 520 will extend the eccentric brakes and pull on the brake cable 518, pulling the eccentric bell crank 600 at the eccentric bell crank brake cable mount 606 towards the eccentric brakes. In this embodiment, permitting the spring tension of the brake spring 520 to impart motion to the eccentric brakes will swing out the eccentric brakes, extending the eccentric brakes until they come in contact with the interior wall of the channel 202 of the track 200 of the incline elevator 100.

In some embodiments, the eccentric brakes are disposed towards the downhill direction of the track 200 of the incline elevator 100. In such an embodiment, the load carrying unit 300 is brought to a stop by the engagement of the eccentric brakes with the interior wall of the channel 200 of the track 200.

Figure 6B:
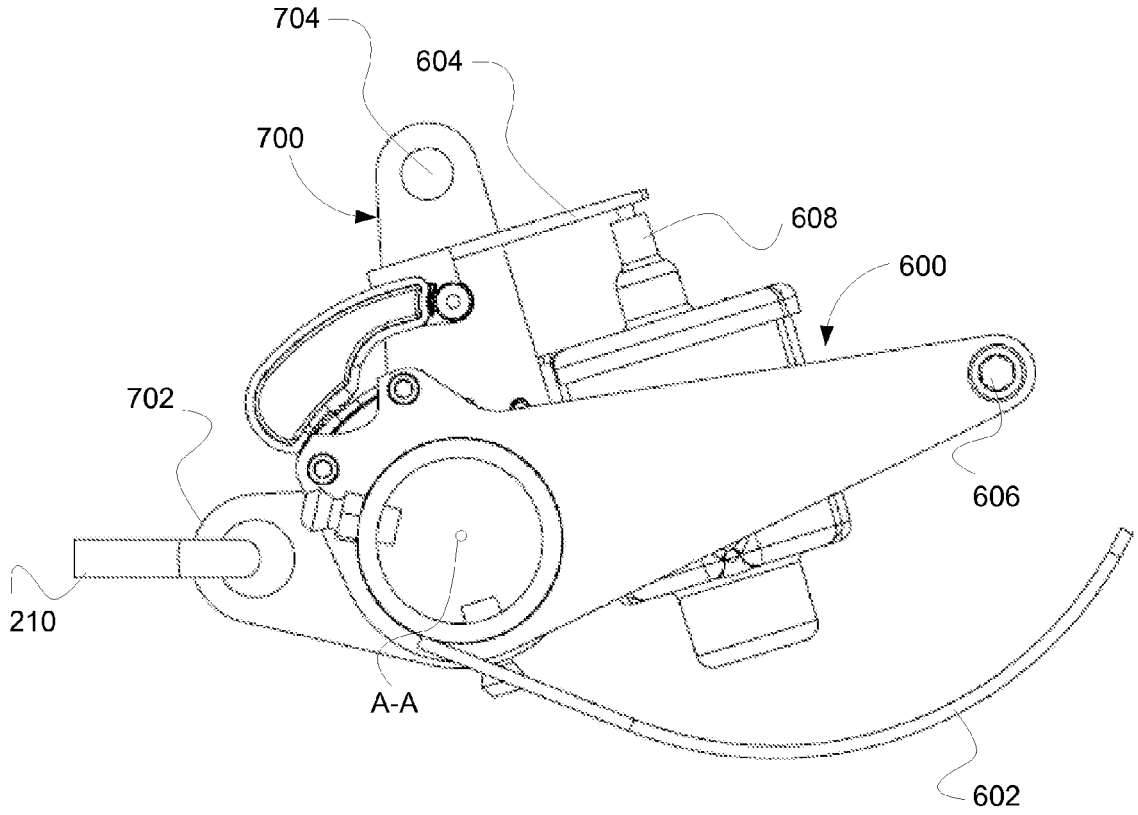

FIG. 6*b* is a side view of an eccentric bell crank 600 for an eccentric safety device 500 of an incline elevator 100, in accordance with an embodiment of the invention. In some embodiments, a solenoid lever 604 of an eccentric bell crank 600 is disposed adjacent to a solenoid 608. When energized, the solenoid 608 comes into contact with the solenoid lever 604 of the eccentric bell crank 600 and imparts movement to the eccentric bell crank 600, rotating the eccentric bell crank 600 counter-clockwise about axis AA. In this embodiment, when the solenoid 608 is energized, rotating the eccentric bell crank 600 counter-clockwise about axis AA, the eccentric bell crank brake cable mount 606 is moved away from the eccentric brakes. The brake cable 518 (not shown in FIG. 6*b*) coupled to the eccentric bell crank brake cable mount 606 actuates the extension and retraction of the eccentric brakes. When the solenoid 608 is energized, the brake cable 518 is pulled, and the eccentric brakes are refracted.

In some embodiments, a docking strip 212 of a track 200 of an incline elevator 100 comes into contact with the docking lever 602 of the eccentric bell crank 600. In some embodiments, when the load carrying unit 300 of the incline elevator 100 has traveled to one of the stations, including the uphill station 114 or the downhill station 116, a docking strip 212 disposed along the track 200 at the station engages the docking lever 602 from underneath the docking lever 602. This engagement imparts motion to the eccentric bell crank 600, rotating it counter-clockwise about axis AA. In this embodiment, when the load carrying unit 300 is at one of the stations so that the docking strip 212 engages the docking lever 602 rotating the eccentric bell crank 600 counter-clockwise about axis AA, the eccentric bell crank brake cable mount 606 is moved away from the eccentric brakes. The brake cable 518 (not shown in FIG. 6*b*) coupled to the eccentric bell crank brake cable mount 606 actuates the extension and retraction of the eccentric brakes. Thus, in this embodiment, when the load carrying unit 300 is at a station, the brake cable 518 is pulled, and the eccentric brakes are retracted.

If the solenoid 608 is not energized and the docking lever 602 is not in contact with a docking strip 212 of the track 200, the spring tension in the brake spring 520 will extend the eccentric brakes and pull on the brake cable 518, pulling the eccentric bell crank 600 at the eccentric bell crank brake cable mount 606 towards the eccentric brakes. In this embodiment, permitting the spring tension of the brake spring 520 to impart motion to the eccentric brakes will swing out the eccentric brakes, extending the eccentric brakes until they come in contact with the interior wall of the channel 202 of the track 200 of the incline elevator 100. Thus, in this embodiment, if the solenoid 608 is not energized and the docking lever 602 is not in contact with a docking strip 212 of the track 200, the eccentric brakes will extend. A predicate condition for the eccentric brakes to be retracted is that the solenoid 608 must either be energized, or the load carrying unit 300 must be docked.

Figure 7A:
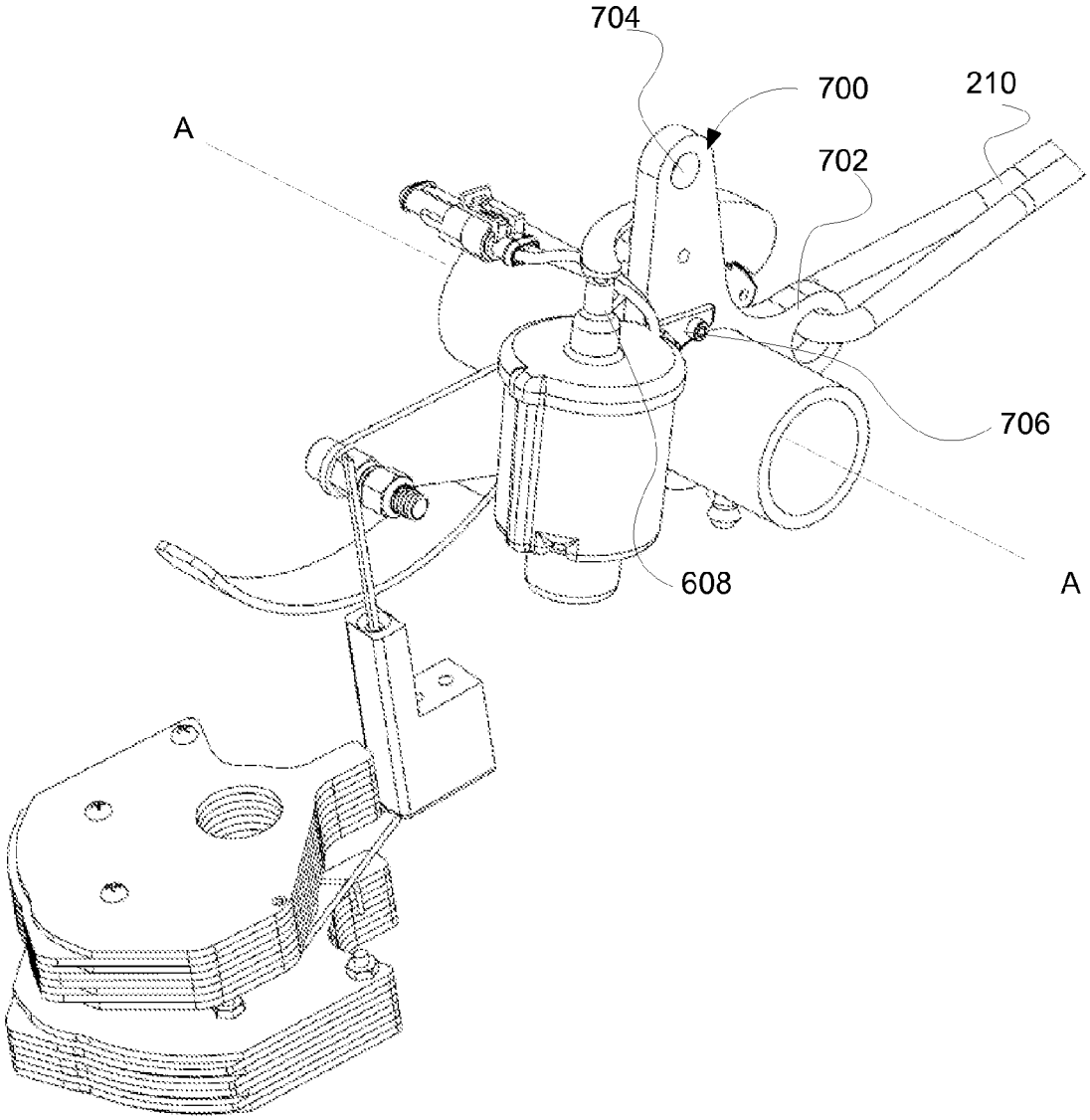
FIGS. 7*a* and 7*b* are views of a hoist bell crank of an eccentric safety device of an incline elevator, in accordance with an embodiment of the invention.

FIG. 7*a* is a perspective view of a hoist cable bell crank 700 of an eccentric safety device 500 of an incline elevator 100, in accordance with an embodiment of the invention. In some embodiments, a hoist cable bell crank 700 includes a hoist cable bell crank mount 702, a safety link mount 704, and a solenoid mount 706. In some embodiments, a hoist cable bell crank 700 rotates about axis AA. In this embodiment, axis AA is the center lengthwise axis of an axle 418 of a truck 400. A hoist cable bell crank 700 is mounted to a truck 400 along an axle 418 of the truck 400 by being threaded onto the outside of one axle 418 of the truck 400. That is, the axle 418 of the truck 400 passes through the hoist cable bell crank 700 along axis AA. In this embodiment, a hoist cable bell crank 700 is disposed adjacent to the eccentric bell crank 600. Importantly, in this embodiment, an eccentric bell crank 600 and a hoist cable bell crank 700 rotate independently of one another about axis AA.

In some embodiments, a hoist cable bell crank 700 is spring loaded. In such embodiments, the hoist cable bell crank 700 is tensionally biased to rotate towards the eccentric brakes. That is, viewing FIG. 7*a*, a hoist cable bell crank 700 is tensionally biased by a tension spring to rotate counter-clockwise about axis AA. In this embodiment, when a hoist cable 210 is attached to the hoist cable bell crank mount 702, and the hoist cable is pulled, the tension of the hoist cable being pulled rotates the hoist cable bell crank 700 clockwise about axis AA.

In some embodiments, a solenoid 608 is mounted to the hoist cable bell crank 700 using a solenoid mount 706. In such embodiments, the solenoid 608 is rotatable about the axle 418 of the truck 400 depicted by axis AA in FIG. 7*a*. Thus, when the hoist cable 210 is under tension, the solenoid 608 is rotated into a position where it can engage the solenoid lever 604 of the eccentric bell crank 600. When the hoist cable 210 is not under tension, as in the emergency situation of a hoist cable break, the spring tension of the hoist cable bell crank 700 will rotate the solenoid 608 out of position towards the eccentric brakes. In this embodiment, if there is a break in the hoist cable 210, irrespective of whether the solenoid 608 is energized, the eccentric bell crank can not be engaged. In this embodiment, if there is a break in the hoist cable 210 and the load carrying unit 300 is not docked, the eccentric bell crank 600 can be rotated by the tension from the brake spring 520. Consequently, in this embodiment, if the load carrying unit 300 is not docked and the hoist cable 210 breaks, the eccentric brakes will extend, stopping any motion of the load carrying unit.

Figure 7B:
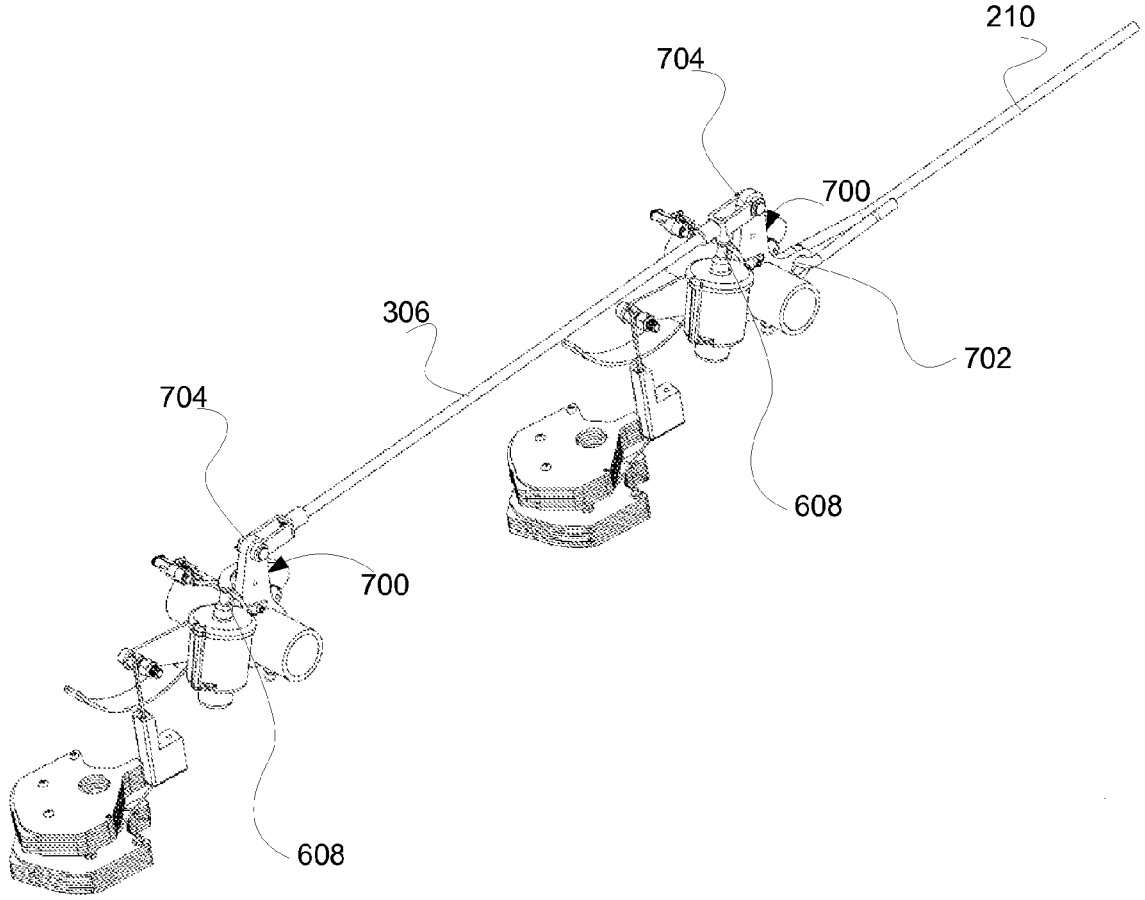

FIG. 7*b* is a perspective view of a safety link 306 joining two hoist cable bell cranks 700, in accordance with an embodiment of the invention. In some embodiments, an eccentric safety device 500, including an eccentric bell crank 600 and a hoist cable bell crank 700, is coupled to an axle 418 of one or more trucks 400. In the depicted embodiment, an eccentric safety device 500 is deployed on each of two trucks 400 of a load carrying unit 300. In this embodiment, there is a single hoist cable 210 carrying the load carrying unit 300, the hoist cable 210 being coupled with the uphill truck 400 of the load carrying unit 300 at the hoist cable bell crank mount 702. The downhill truck 400 of the load carrying unit 300 does not have a connection to the hoist cable 210. In this embodiment, a safety link 306 couples the two eccentric safety devices 500, one on each truck 400. The safety link 306 is coupled at opposing ends of the safety link 306 to a safety link mount 704 on the hoist cable bell crank 700 on each of the uphill truck 400 and downhill truck 400, the uphill and downhill trucks 400 supporting the load carrying unit 300. In this embodiment, if there is a break in the hoist cable 210, the hoist cable bell cranks 700 on both of the trucks are under spring tension and move the solenoids 608 out of position, causing the eccentric brakes of both eccentric safety devices 500 to extend. In this embodiment, when the hoist cable 210 is under tension, the hoist cable 210 pulls the hoist cable bell crank 700 of the uphill truck at the hoist cable bell crank mount 702. In this embodiment, when the hoist cable 210 is under tension, the safety link 306 is also under tension, which rotates the hoist cable bell crank 700 of the downhill truck at the safety link mount 704. In this embodiment, the movement of the hoist cable bell crank 700 of the uphill and downhill eccentric safety devices 500 is in harmony, and the movement of the eccentric brakes of the uphill and downhill eccentric safety devices 500 is the same and simultaneous.

Figure 8A:
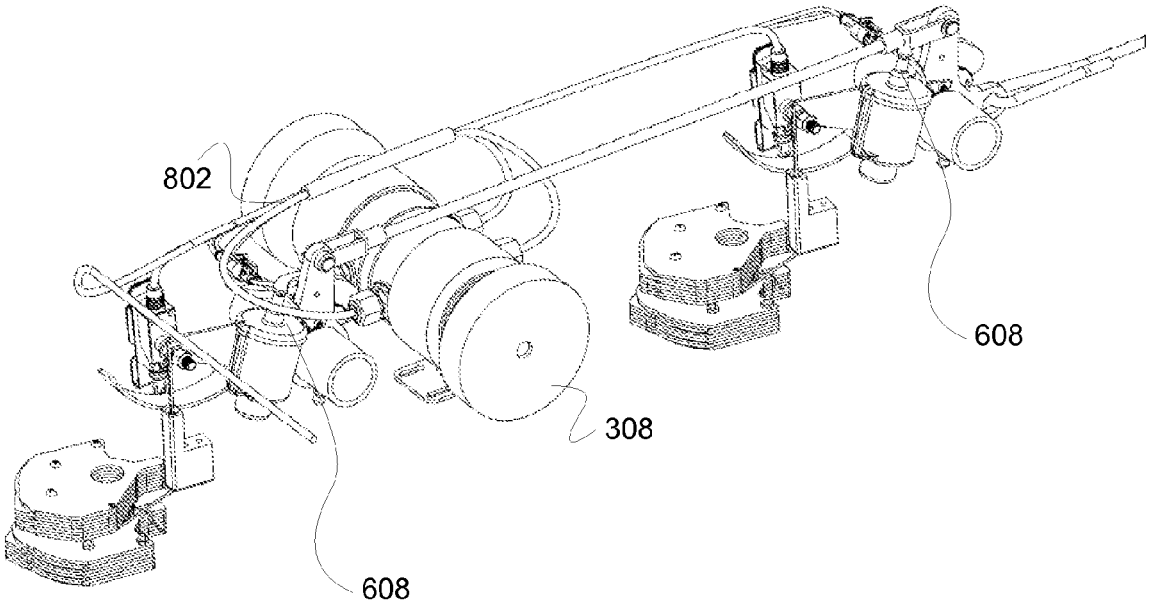
FIGS. 8*a* and 8*b* are views of a speed sensor coupled with an eccentric safety device of an incline elevator, in accordance with an embodiment of the invention.
Figure 8B:
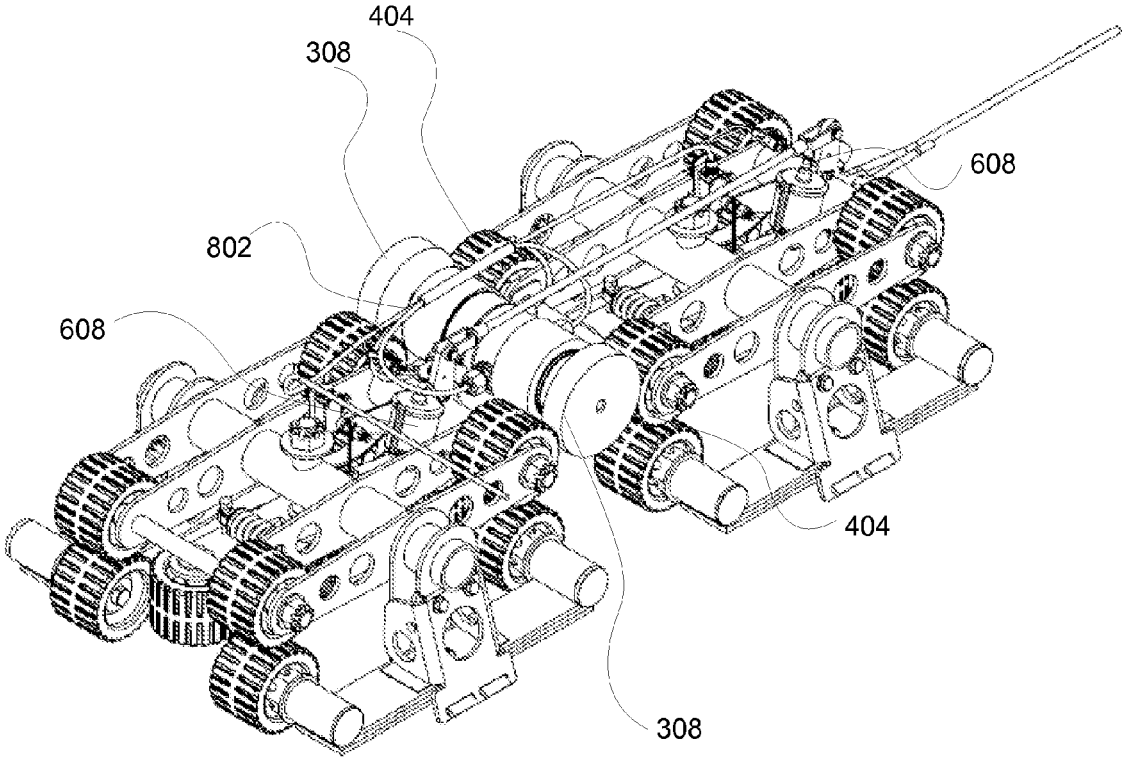

FIG. 8*a* is a perspective view of a speed sensor 308 coupled with an eccentric safety device 500 of an incline elevator 100, in accordance with an embodiment of the invention. FIG. 8*b* is a perspective view of a speed sensor 308 coupled with an eccentric safety device 500 integrated with a truck 400 of an incline elevator 100, in accordance with an embodiment of the invention. In some embodiments, a speed sensor 308 is in series with electrical power to a solenoid 608, the electrical power being delivered by electrical wiring 802. In a certain embodiment, a speed sensor 308 makes physical contact with a top roller 404 of a truck 400. In this embodiment, a speed sensor 308 measures the speed of the load carrying unit 300 at its top roller 404. In this embodiment, a speed sensor 308 provides electrical power to the solenoid 608 only when the speed sensor 308 detects speed below a pre-determined safe speed. In such an embodiment, in which the solenoid 608 must be energized for the eccentric brakes to be retracted, if the speed sensor 308 detects an overspeed condition, electrical power to the solenoid 608 is not supplied, causing the eccentric brakes to extend. In some embodiments, there is more than one speed sensor 308 for redundancy. It will be recognized by one skilled in the art that placing the one or more speed sensors 308 in series with the one or more solenoids 608 will provide multiple layers of safety, in that if the electrical power to the entire system fails, the one or more solenoids 608 will de-energize causing the eccentric brakes to extend; and, if the one or more speed sensors 308 detect an overspeed condition, the one or more speed sensors 308 will still be receiving electrical power but will cut off the electricity to the solenoids 608, causing the eccentric brakes to extend. In some embodiments, a speed sensor 308 is an ESS Electronic Speed Switch available at www.torq.com.

Figure 9A:
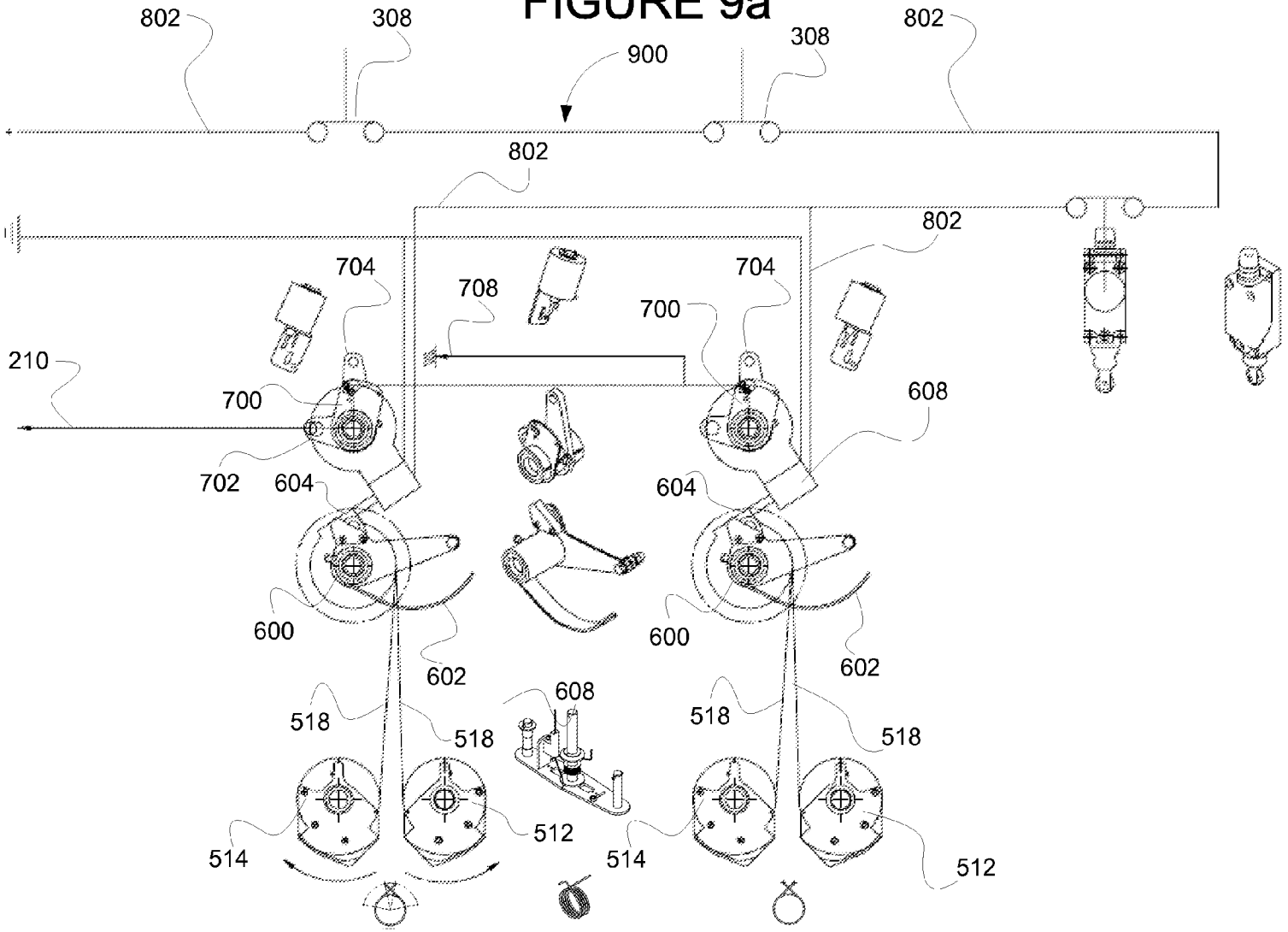
FIGS. 9*a*, 9*b*, and 9*c* are schematic views of a system for providing an eccentric safety device for an incline elevator, in accordance with an embodiment of the invention.

FIG. 9*a* is a schematic view of a system 900 for providing an eccentric safety device for an incline elevator, in accordance with an embodiment of the invention. In this embodiment, a system 900 for providing an eccentric safety device for an incline elevator includes electric wiring 802, one or more speed sensors 308, a hoist cable 210, and one or more hoist cable bell cranks 700, the one or more hoist cable bell cranks 700 having a hoist cable bell crank spring 708, a hoist cable bell crank mount 702, a hoist cable bell crank safety link mount 704, and a solenoid 608. A system 900 for providing an eccentric safety device for an incline elevator also includes one or more eccentric bell cranks 600, the one or more eccentric bell cranks 600 having a docking lever 602, and a solenoid lever 604. A system 900 for providing an eccentric safety device for an incline elevator also includes one or more brake cables 518, one or more bottom eccentric brakes 512, and one or more top eccentric brakes 514.

In some embodiments, each of the one or more solenoids 608 are mounted on a hoist cable bell crank 700. In some embodiments, a hoist cable bell crank 700 is tensionally biased by a hoist cable bell crank spring 708. In some embodiments, a hoist cable bell crank 700 includes a hoist cable bell crank mount 702 to which a hoist cable 210 is attached. In such an embodiment, when the hoist cable 210 is under tension, the tension from the hoist cable 210 counteracts the spring tension from the hoist cable bell crank spring 708. In such an embodiment, a solenoid 608 is mounted on a hoist cable bell crank 700. Thus, in this embodiment, when a hoist cable 210 pulls a hoist cable bell crank 700, the solenoid 608 is rotated into position to engage an eccentric bell crank 600 if the solenoid 608 is energized. Thus, in this embodiment, for a solenoid 608 to be in position to engage an eccentric bell crank 600 when the solenoid 608 is energized, there must be hoist cable tension. In some embodiments, a hoist cable bell crank 700 is mounted on one or more trucks 400 of a load carrying unit 300 of an incline elevator. In such embodiments, a safety link 306 (not pictured in FIG. 9*a*) joins the hoist cable bell cranks 700 at the hoist cable bell crank safety link mounts 704. In this embodiment, when the hoist cable 210 provides tension to rotate an uphill hoist cable bell crank 700, a downhill hoist cable bell crank 700 is also rotated by the safety link 306.

In some embodiments, electrical power is provided from the power source of the incline elevator 100. It will be recognized by those with skill in the art that the power source of the incline elevator 100 can be virtually any power source. In some embodiments, from the power source of the incline elevator 100, electrical wiring 802 provides power for an eccentric safety device of an incline elevator. In some embodiments, in series with electrical wiring 802 are one or more speed sensors 308 and one or more solenoids 608. In such embodiments, power to the one of more solenoids 608 is only available if the power source of the incline elevator 100 is operable. In a further embodiment, the one or more speed sensors 308 only provide power to the one or more solenoids 608 if the one or more speed sensors 308 are in an underspeed condition. In this embodiment, the one or more solenoids 308 are only energized if there has not been an electrical fault in the incline elevator 100, and if there is not an overspeed condition detected by the speed sensors 308.

Importantly, in some embodiments, an eccentric bell crank 600 can only be moved by a solenoid 608 when the solenoid 608 is in position due to the tension in the hoist cable 210 on the hoist cable bell crank 700. Additionally, in such embodiments, if a solenoid 608 is in position, an eccentric bell crank 600 can only be moved by a solenoid 608 when the solenoid 608 is energized, which is only possible when there is no electrical fault in the incline elevator 100, and when the speed sensors 308 are in an underspeed condition. Thus, an eccentric bell crank 600 can be moved by the solenoid 608 when there is no electrical fault in the incline elevator 100, when there is no overspeed condition detected by the speed sensors 308, and when there is no lack of tension in the hoist cable 210.

In some embodiments, an eccentric bell crank 600 is coupled to a bottom eccentric brake 512 and to a top eccentric brake 514 by a brake cable 518. In some embodiments, an eccentric bell crank 600 includes a docking lever 602 and a solenoid lever 604. In some embodiments, when a solenoid 608 is in position and energized, the solenoid makes contact with the docking lever 602 and rotates the eccentric bell crank 600. In this embodiment, the rotation of the eccentric bell crank 600 imparts motion to the eccentric brakes via the brake cable 518, retracting the eccentric brakes. In this embodiment, when a solenoid 608 is in position and energized, the eccentric brakes are retracted. In this embodiment, if a solenoid 608 is not in position (irrespective of whether it is energized) or not energized (irrespective of whether it is in position), the eccentric brakes are extended due to spring tension from the brake spring 520.

In some embodiments, an eccentric bell crank 600 includes a docking lever 602. In this embodiment, a docking lever 602 can be engaged by docking targets in the track 200. In this embodiment, a docking target in contact with the docking lever 602 rotates the eccentric bell crank 600. In this embodiment, when the contact between the docking target in the track 200 and the docking lever 602 rotates the eccentric bell crank 600, the eccentric brakes are retracted by the brake cable 518. In this embodiment, when the load carrying unit 300 of the incline elevator 100 is docked, the eccentric brakes are refracted. Therefore, in this embodiment, when the load carrying unit 300 of the incline elevator 100 is docked, the eccentric brakes are retracted irrespective of the position or energy state of the solenoid 608.

Importantly, in this embodiment, if the load carrying unit 300 is not docked, and if there is any electrical fault, overspeed, or break in the hoist cable 210, the solenoid 608 will not be energized and the eccentric brakes will extend due to the spring tension in the brake spring 520.

Figure 9B:
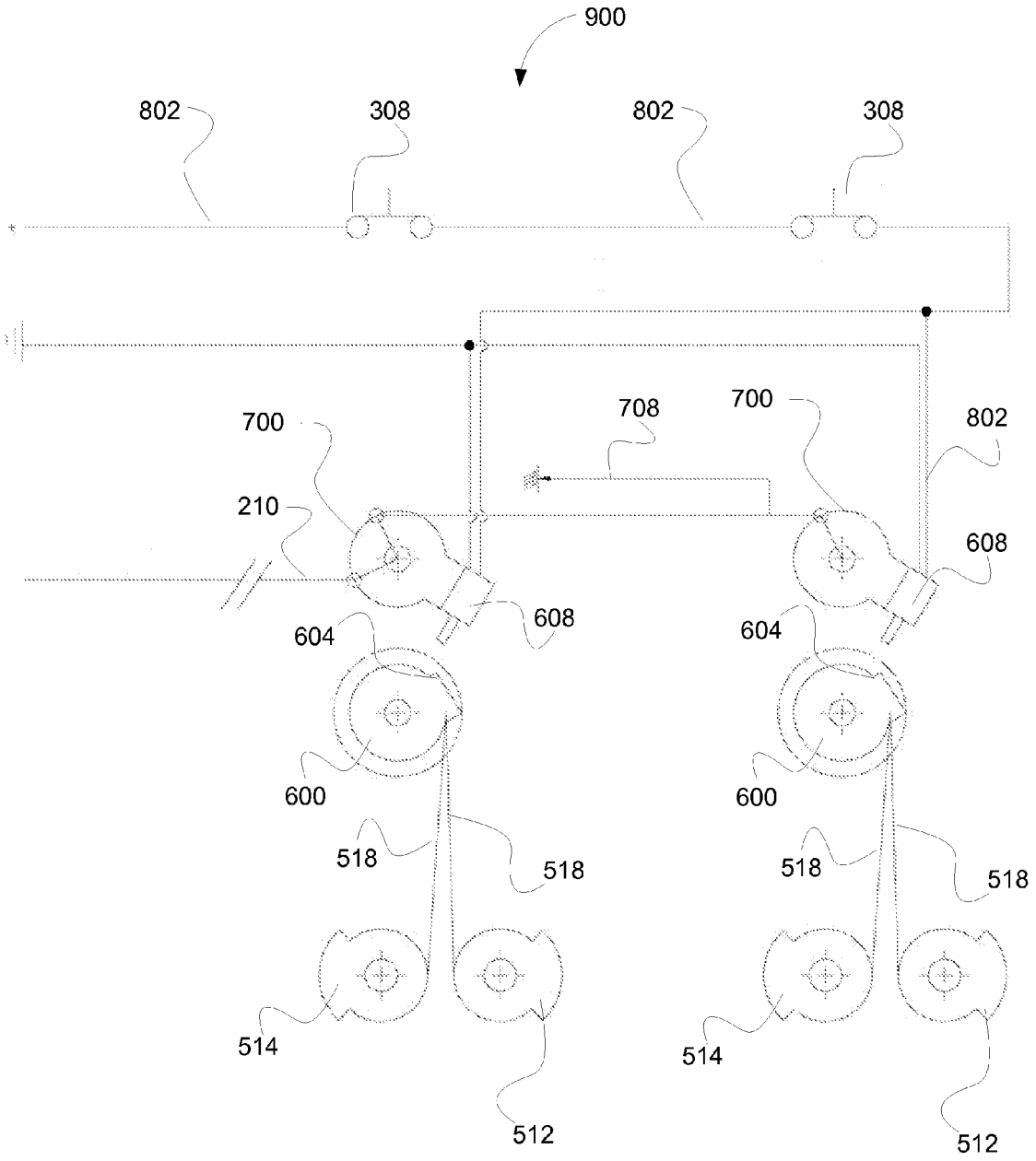

FIG. 9*b* is a schematic view of a system 900 for providing an eccentric safety device for an incline elevator, in accordance with an embodiment of the invention. While FIG. 9*a* depicts the eccentric brakes of the system retracted, permitting an incline elevator 100 to move the load carrying unit 300 up and down the track 200, in FIG. 9*b* what is depicted is a break in hoist cable 210. In some embodiments, if there is a break in hoist cable 210, the eccentric safety device 500 is rigged to deploy. In some embodiments, when there is a break in the hoist cable 210, tension in the hoist cable bell crank spring 708 will rotate the one or more hoist cable bell cranks 700 unchecked by any tension in the broken hoist cable 210 in this embodiment. In such embodiments, when the one or more hoist cable bell crank springs 700 rotate due to the spring tension in the hoist cable bell crank spring 708, the one or more solenoids 608 move out of position such that it can no longer engage the one or more eccentric bell cranks 600. In this embodiment, irrespective of the power state of the incline elevator 100 or the overspeed or underspeed condition detected by the one or more speed sensors 308, the one or more eccentric bell cranks 600 will be driven by the spring tension in the brake spring 520 (brake spring 520 not shown in FIG. 9*b*). In this embodiment, the spring tension in the brake spring 520 will extend the bottom eccentric brake 512 and the top eccentric brake 514. In this embodiment, the spring tension of the brake spring 520 will also pull the brake cable 518 and swing the one or more eccentric bell cranks 600 away from the one or more solenoids 608, where the one or more solenoids 608 have been also pulled out of position by tension in the hoist cable bell crank spring 708, the tension being unchecked by tension in the hoist cable 210. In this embodiment, the extension of the eccentric brakes will bring the brakes in contact with the inside of the channel 202 of the track 200 of the incline elevator 100. In this embodiment, the extension of the eccentric brakes will bring the load carrying unit 300 to a stop.

In some embodiments, the bottom eccentric brake 512 and the top eccentric brake 514 are made of alternating layers of rubber and steel to bring the load carrying unit 300 to a more smooth halt, making the emergency stop less uncomfortable for passengers. In some embodiments, the pear-shaped design of the eccentric brakes, having a fat end at the downhill side and a skinny end at the uphill side, enables the load carrying unit 300 with its one or more eccentric safety devices 500 to be towed uphill even after deployment of the eccentric brakes. It will be clear to one with skill in the art that when towing the load carrying unit 300, the eccentric brakes will drag against the inside of the channel 202 of the track 200, but that only spring tension in the brake spring 520 will resist the motion. Uphill forces on the hoist cable 210 will permit the load carrying unit 300 to be towed uphill. When the eccentric brakes are extended, however, the fat end of the eccentric brakes will "jam" in the channel 202 of the track 200, causing the load carrying unit 300 to stop.

In some embodiments, to return the unit to service, the load carrying unit 300 is towed to an uphill station such as uphill station 114. In such embodiments, when the load carrying unit 300 is towed to the uphill station 114, docking targets in the track 200 engage the docking lever 602 of the eccentric bell crank 600, which retracts the eccentric brakes. In this embodiment, when power is re-applied to the incline elevator 100 and the hoist cable 210 has tension, the one or more solenoids 608 engage the one or more eccentric bell cranks 600, keeping the eccentric brakes retracted even when the load carrying unit 300 moves away from the uphill station 114.

Figure 9C:
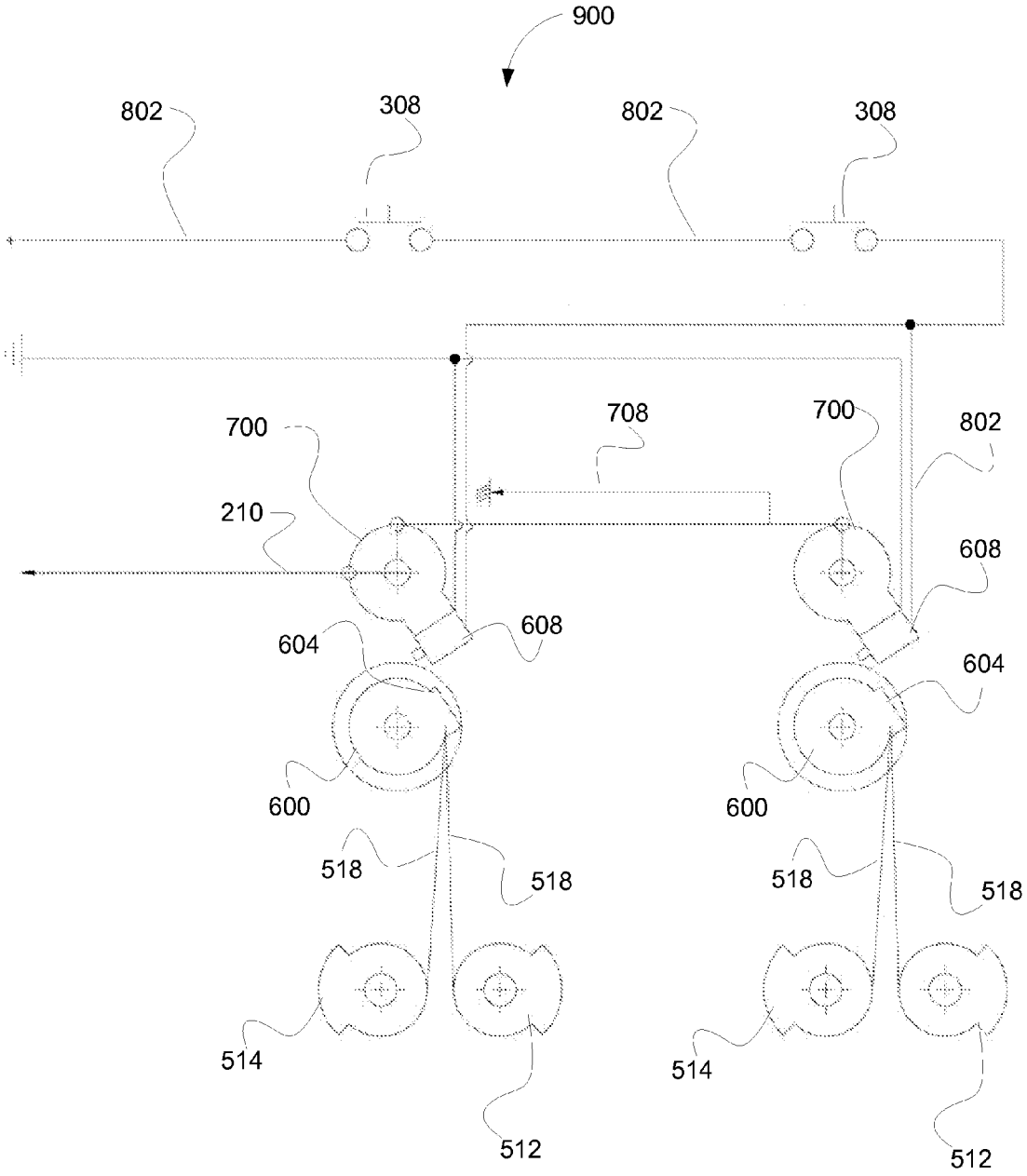

FIG. 9*c* is a schematic view of a system 900 for providing an eccentric safety device for an incline elevator, in accordance with an embodiment of the invention. While FIG. 9*a* depicts the eccentric brakes of the system retracted, permitting an incline elevator 100 to move the load carrying unit 300 up and down the track 200, in FIG. 9*c* what is depicted is an electrical fault in the incline elevator 100 or an overspeed condition detected by the one or more speed sensors 308. In some embodiments, the speed sensors 308 are electrical devices, the power for which is provided by the electrical system of the incline elevator 100. In such embodiments, when the speed sensors 308 are energized, power can be provided to the one or more solenoids 608. In such embodiments, when the speed sensors 308 are energized, the power to the one or more solenoids 608 is only provided to the one or more solenoids 608 when the speed sensors 308 detect an underspeed condition. In this embodiment, if the speed sensors 308 detect an overspeed condition, the speed sensors 308 will cut power to the one or more solenoids 608. If power to the one or more solenoids 608 is cut, the one or more solenoids 608 will break contact with the one or more eccentric bell cranks 600. In this embodiment, when the one or more solenoids 608 are not engaging the one or more eccentric bell cranks 600, then there is no check on the spring tension of the brake spring 520. In this embodiment, if the one or more solenoids 608 are not engaging the one or more eccentric bell cranks 600, the tension in the brake spring 520 will cause the bottom eccentric brake 512 and the top eccentric brake to extend, and the tension in the brake spring 520 will pull on the brake cable 518, causing the one or more eccentric bell cranks 600 to rotate away from the solenoid 608.

In some embodiments, to return the unit to service, the load carrying unit 300 is towed to an uphill station such as uphill station 114. In such embodiments, when the load carrying unit 300 is towed to the uphill station 114, docking targets in the track 200 engage the docking lever 602 of the eccentric bell crank 600, which retracts the eccentric brakes. In this embodiment, when power is re-applied to the incline elevator 100 and the hoist cable 210 has tension, the one or more solenoids 608 engage the one or more eccentric bell cranks 600, keeping the eccentric brakes retracted even when the load carrying unit 300 moves away from the uphill station 114.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A safety brake for an incline elevator, comprising:

a bottom frame;

a center pin, the center pin being mounted to the bottom frame at or near a center of the bottom frame;

one or more eccentric brakes, the one or more eccentric brakes being swivelably mounted to the center pin, the one or more eccentric brakes being pear-shaped having a fat end disposed in a downhill direction of the incline elevator, the one or more eccentric brakes being spring-loaded to rotate the fat end laterally to engage an interior wall of a U-shaped track of the incline elevator;

an eccentric bell crank, the eccentric bell crank being swivelably mounted on an axle of a truck of a load carrying unit of the incline elevator, the eccentric bell crank including at least:

a docking lever; and a solenoid lever; and a brake cable, the brake cable coupling the eccentric bell crank with the one or more eccentric brakes.

2. The safety brake for an incline elevator of claim 1, wherein the center pin is swivelably mounted to the underside of a truck of a load carrying unit of the incline elevator.

3. The safety brake for an incline elevator of claim 1, wherein the safety brake further comprises:

an uphill guide roller and a downhill guide roller, the uphill and downhill guide rollers being disposed on opposing ends of the bottom frame of the safety brake;

a coil spring mount, the coil spring mount being a pin fixedly mounted to the bottom frame of the safety brake; and a coil spring, the coil spring being coupled to the coil spring mount, the coil spring coupled at the opposing end of the coil spring to a truck of a load carrying unit of the incline elevator, where the coil spring tensionally biases the swivelably mounted safety brake underneath the truck of the load carrying unit such that the uphill and downhill guide rollers engage opposing interior walls of a U-shaped track of the incline elevator.

4. The safety brake for an incline elevator of claim 1, further comprising:

a hoist cable bell crank, the hoist cable bell crank being swivelably mounted on an axle of a truck of a load carrying unit of the incline elevator;

a hoist cable bell crank spring, the hoist cable bell crank being tensionally biased by the hoist cable bell crank spring;

a solenoid mounted to the hoist cable bell crank; and a hoist cable bell crank mount.

5. The safety brake for an incline elevator of claim 4, further comprising one or more speed sensors, the one or more speed sensors engaging a roller wheel of a truck of a load carrying unit of the incline elevator, the one or more speed sensors being electrically powered by a power source of the incline elevator, wherein the one or more speed sensors are in an electrical series circuit with the solenoid.

6. The safety brake for an incline elevator of claim 5, wherein the eccentric brakes retract when a hoist cable of the incline elevator mounted to the hoist cable bell crank mount has tension and the one or more speed sensors detect an underspeed condition.

7. The safety brake for an incline elevator of claim 5, wherein the eccentric brakes extend when a hoist cable of the incline elevator mounted to the hoist cable bell crank mount is not in tension, or the one or more speed sensors are not energized, or the one or more speed sensors detect an overspeed condition.

8. A braking arrangement for an incline elevator, comprising:

one or more eccentric brakes swivelably mounted to a cab of the incline elevator; and one or more braking arrangements, the one or more braking arrangements configured to at least:

extend the one or more eccentric brakes at least upon a fault in the incline elevator; and retract the one or more eccentric brakes at least upon the cab docking at one or more docking targets of the incline elevator.

9. The braking arrangement for an incline elevator of claim 8, wherein the fault may include a power failure.

10. The braking arrangement for an incline elevator of claim 8, wherein the one or more braking arrangements comprise:

one or more braking arrangements including at least one or more speed sensors electrically coupled with the one or more eccentric brakes, the one or more braking arrangements configured to at least extend the one or more eccentric brakes at least upon at least one speed sensor detecting an overspeed condition.

11. The braking arrangement for an incline elevator of claim 8, wherein the one or more braking arrangements comprise:

one or more braking arrangements configured at least to detect an overspeed condition and to detect a break in a hoist cable, the one or more braking arrangements configured to at least extend all of the one or more eccentric brakes at least upon one or more of an overspeed condition being detected or a break in a hoist cable being detected.

12. A braking arrangement for an incline elevator, comprising:

means for braking a cab of the incline elevator responsive to a fault in the incline elevator; and means for overriding the means for braking the cab responsive to the cab entering a docking target of the incline elevator.

13. A braking arrangement for an incline elevator, comprising:

circuitry for extending one or more eccentric brakes of the incline elevator;

circuitry for retracting the one or more eccentric brakes of the incline elevator; and circuitry for resetting the one or more eccentric brakes of the incline elevator;

wherein at least one of retracting or resetting the one or more eccentric brakes of the incline elevator is responsive to the incline elevator entering a docking target.

14. The braking arrangement for an incline elevator of claim 13, further comprising:

a mechanical arrangement for retracting the one or more eccentric brakes of the incline elevator, the mechanical arrangement configured at least to override the circuitry for controlling one or more eccentric brakes of the incline elevator when a cab of the incline elevator docks at a docking target.

15. The braking arrangement for an incline elevator of claim 13, further comprising:

a mechanical arrangement for extending the one or more eccentric brakes of the incline elevator, the mechanical arrangement configured at least to extend the one or more eccentric brakes of the incline elevator upon the circuitry for controlling one or more eccentric brakes of the incline elevator being de-energized.

16. The braking arrangement for an incline elevator of claim 13, wherein the circuitry for controlling one or more eccentric brakes of the incline elevator comprises:

circuitry for extending the one or more eccentric brakes of the incline elevator at least upon an overspeed condition being detected.

17. The braking arrangement for an incline elevator of claim 16, further comprising:

one or more solenoids, the one or more solenoids configured to at least partially control the one or more eccentric brakes of the incline elevator, the one or more solenoids in series with the circuitry for extending the one or more eccentric brakes of the incline elevator at least upon an overspeed condition being detected.

18. The braking arrangement for an incline elevator of claim 13, further comprising:

one or more solenoids springably swivelably mounted to a cab of the incline elevator, the one or more solenoids coupled with a hoist cable of the incline elevator, wherein a break in the hoist cable causes the one or more solenoids to springably rotate, the rotation causing the one or more solenoids to disengage from the one or more eccentric brakes.

19. A method of controlling one or more eccentric brakes of an incline elevator, comprising:

monitoring the incline elevator for all of an overspeed condition, a break in a hoist cable, and a power failure, wherein the monitoring is at least partially implemented using circuitry, and, if any of an overspeed condition, a break in a hoist cable, or a power failure occur, extending the one or more eccentric brakes of the incline elevator; and retracting the one or more eccentric brakes of the incline elevator in response to a cab of the incline elevator docking at a docking target of the incline elevator.

20. The method of claim 19, wherein the retracting the one or more eccentric brakes of the incline elevator further comprises maintaining the one or more eccentric brakes of the incline elevator in a retracted state upon departure from the docking target.

21. The method of claim 19, wherein the circuitry includes at least one mechanical indicator of an overspeed condition, a break in a hoist cable, and a power failure.

* * * * *